US010603706B2

(12) United States Patent
Kubo et al.

(10) Patent No.: US 10,603,706 B2
(45) Date of Patent: Mar. 31, 2020

(54) METHOD OF PRODUCING MOLDED PRODUCT AND MOLDED PRODUCT

(71) Applicant: NIPPON STEEL & SUMITOMO METAL CORPORATION, Tokyo (JP)

(72) Inventors: Masahiro Kubo, Tokyo (JP); Yoshiaki Nakazawa, Tokyo (JP); Hiroshi Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/781,891

(22) PCT Filed: Nov. 30, 2016

(86) PCT No.: PCT/JP2016/085633
§ 371 (c)(1),
(2) Date: Jun. 6, 2018

(87) PCT Pub. No.: WO2017/098983
PCT Pub. Date: Jun. 15, 2017

(65) Prior Publication Data

US 2018/0361456 A1 Dec. 20, 2018

(30) Foreign Application Priority Data

Dec. 11, 2015 (JP) ..... 2015-242460
Sep. 15, 2016 (JP) ..... 2016-180635

(51) Int. Cl.
*B21D 22/20* (2006.01)
*C21D 9/48* (2006.01)
(Continued)

(52) U.S. Cl.
CPC ..... *B21D 22/20* (2013.01); *C21D 9/48* (2013.01); *C22C 38/001* (2013.01);
(Continued)

(58) Field of Classification Search
CPC ..... B21D 22/20
See application file for complete search history.

(56) References Cited

U.S. PATENT DOCUMENTS

2001/0003293 A1 6/2001 Hirata et al.
2012/0312432 A1* 12/2012 Fukutomi ..... C21D 7/13 148/559
(Continued)

FOREIGN PATENT DOCUMENTS

EP 0 936 279 A1 8/1999
JP 9-263900 A 10/1997
(Continued)

OTHER PUBLICATIONS

International Search Report for PCT/JP2016/085633 dated Mar. 7, 2017.
(Continued)

*Primary Examiner* — Pradeep C Battula
(74) *Attorney, Agent, or Firm* — Birch, Stewart, Kolasch & Birch, LLP

(57) ABSTRACT

The method includes treating a metal sheet having a bcc structure and a surface satisfying conditions (a) or (b), molding the metal sheet to cause plane strain tensile deformation and biaxial tensile deformation, and allowing at least one part of the metal sheet to have a sheet thickness decrease rate of from 10% to 30%. Condition (a): an area fraction of crystal grains having a crystal orientation of 15° or less relative to a (001) plane parallel to a surface of the metal sheet is from 0.20 to 0.35. Condition (b): the area fraction of crystal grains having a crystal orientation of 15° or less relative to a (001) plane parallel to a surface of the metal sheet is 0.45 or less, the average crystal grain size thereof is 15 μm or less. The molded product satisfies conditions (a) or (b).

3 Claims, 15 Drawing Sheets

(51) Int. Cl.

| | |
|---|---|
| ***C22C 38/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| *C21D 8/02* | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 8/0236* (2013.01); *C21D 2211/005* (2013.01); *C22C 38/00* (2013.01)

(56) References Cited

U.S. PATENT DOCUMENTS

2013/0153091 A1* 6/2013 Fujita ..... B21B 35/00 148/504
2014/0044989 A1* 2/2014 Toda ..... C22C 38/02 428/659
2015/0371999 A1* 12/2015 Kurusu ..... H01L 27/11551 257/314
2016/0002745 A1 1/2016 Kajihara

FOREIGN PATENT DOCUMENTS

| | | | |
|---|---|---|---|
| JP | 11-117038 | A | 4/1999 |
| JP | 2001-316775 | A | 11/2001 |
| JP | 2002-275595 | A | 9/2002 |
| JP | 5683193 | B2 | 3/2015 |
| JP | 6156613 | B1 | 7/2017 |
| WO | WO 2014/141919 | A1 | 9/2014 |

OTHER PUBLICATIONS

Written Opinion of the International Searching Authority for PCT/JP2016/085633 (PCT/ISA/237) dated Mar. 7, 2017.
Extended European Search Report dated Oct. 22, 2018, in European Patent Application No. 16872881.4.
Decision of the Technical Board of Appeal 3.2.07 dated Jan. 31, 2008, for European Application No. 94102721.1.
European Office Action dated Aug. 26, 2019, for corresponding European Patent Application No. 16872881.4.

* cited by examiner

[Fig. 1]
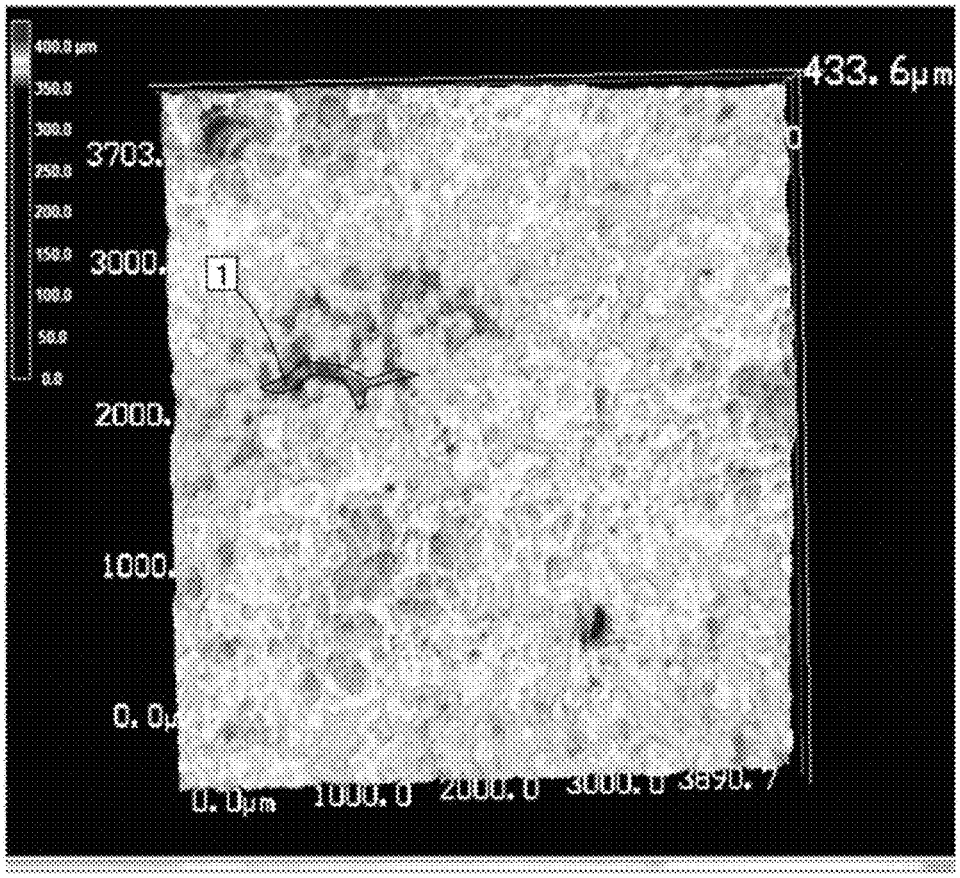
[Fig. 2]
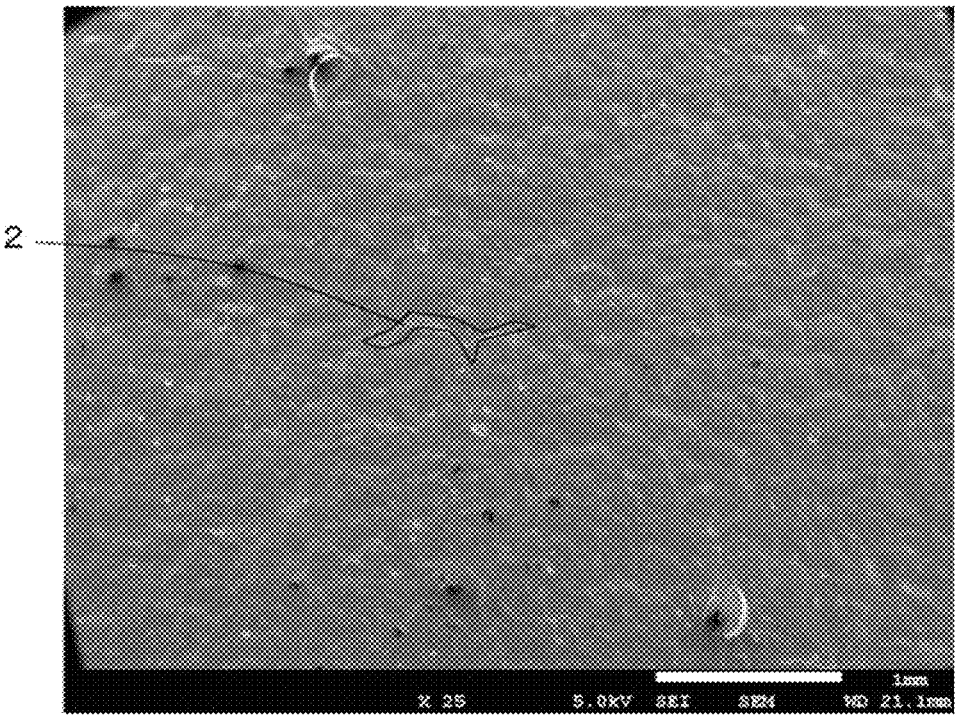

[Fig.3A]
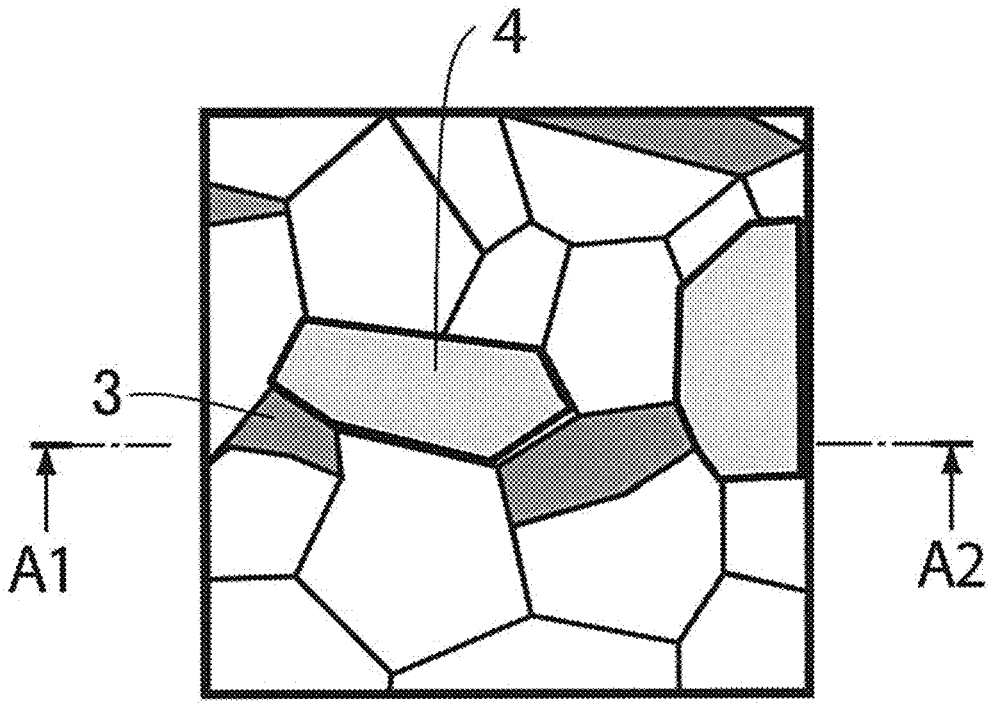
[Fig.3B]
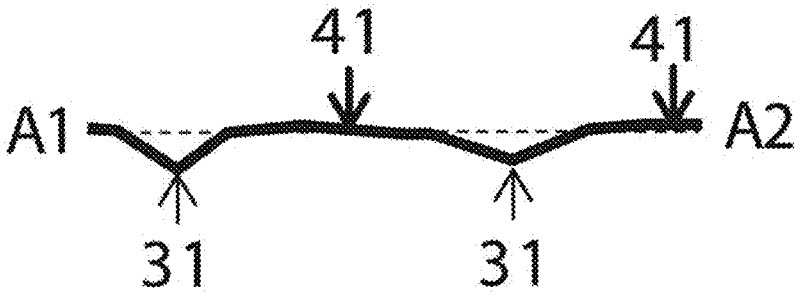

[Fig.4A]
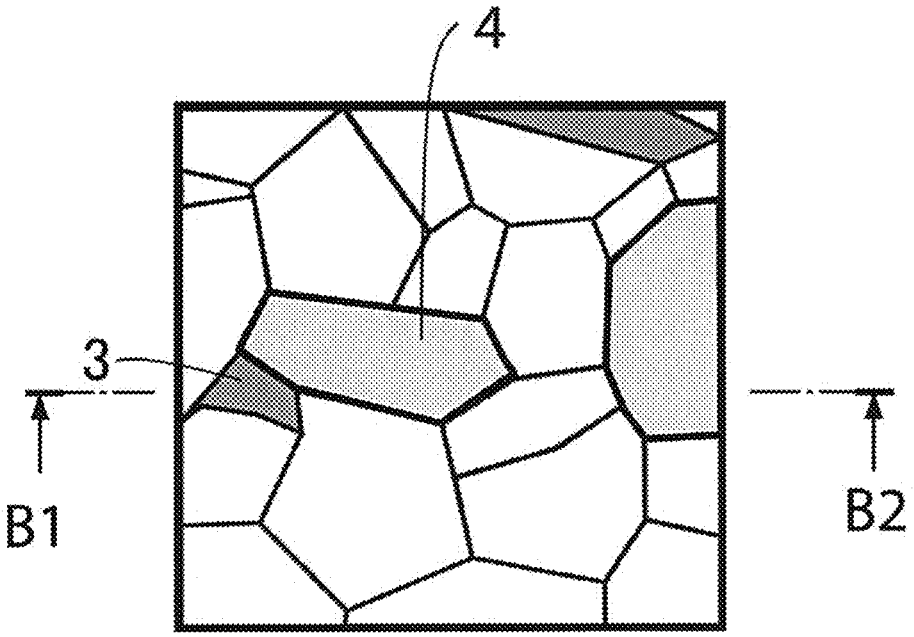
[Fig.4B]
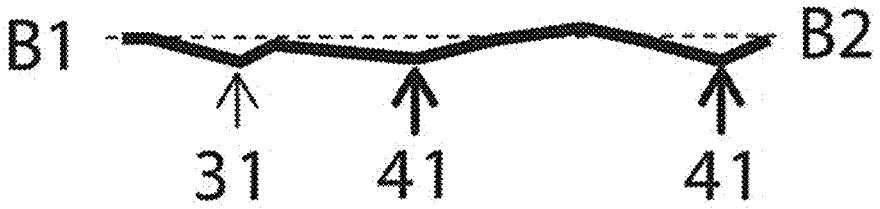

[Fig.5A]
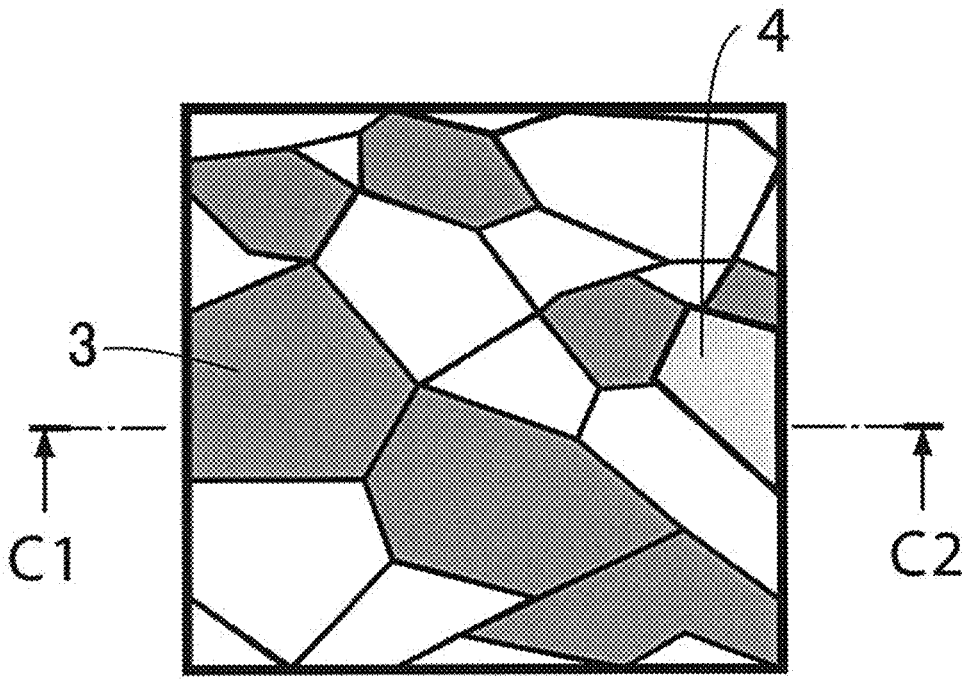
[Fig.5B]
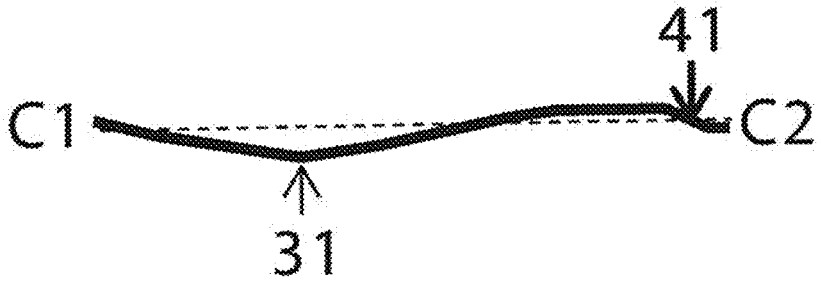

[Fig.6]
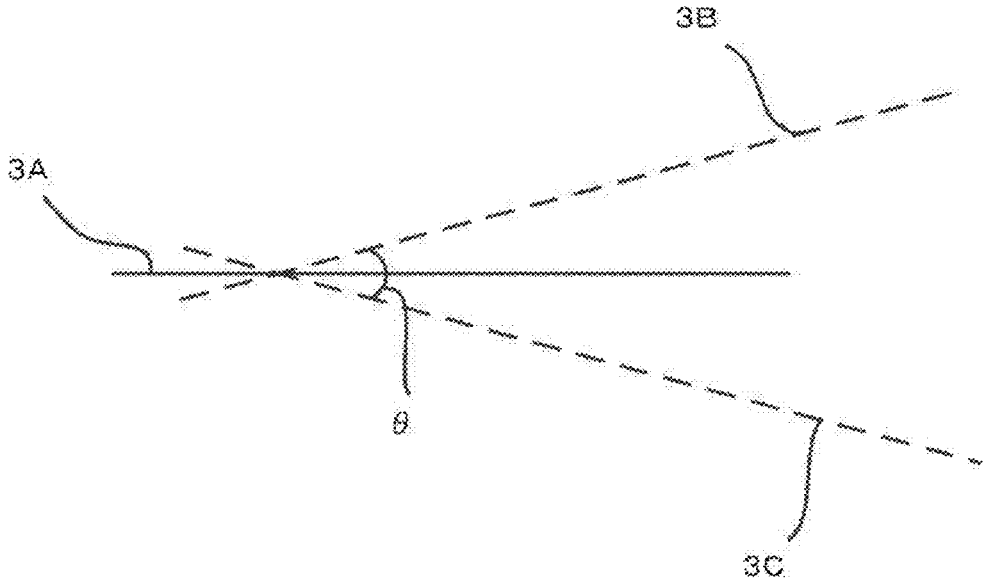

[Fig.7A]
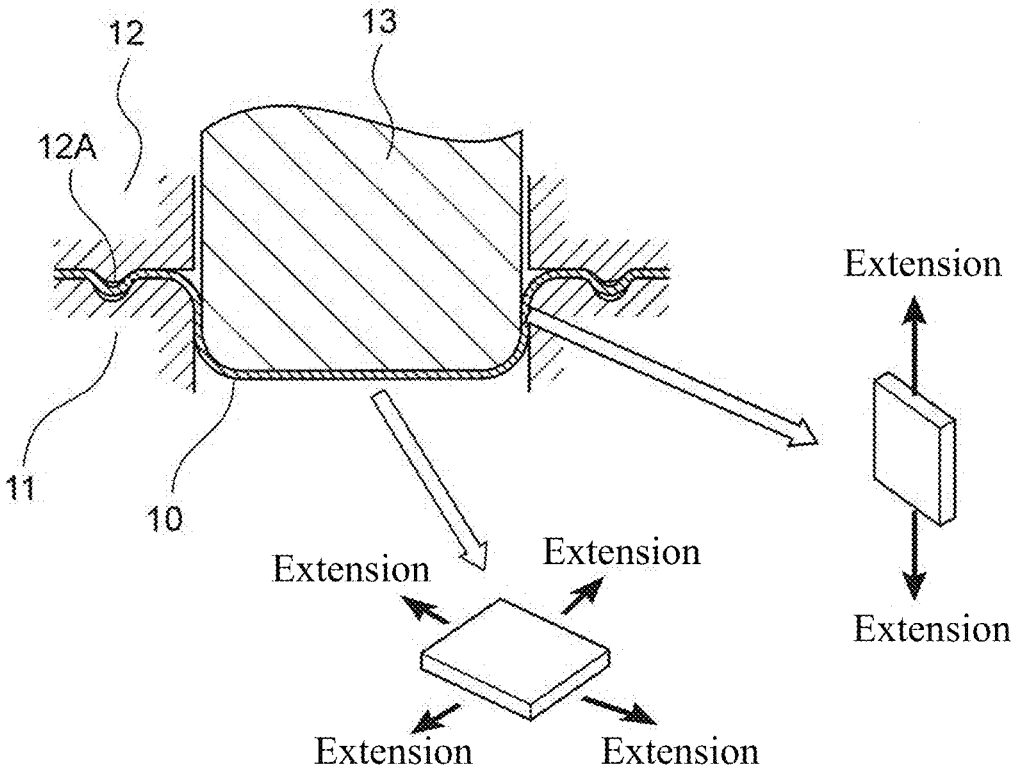
[Fig.7B]
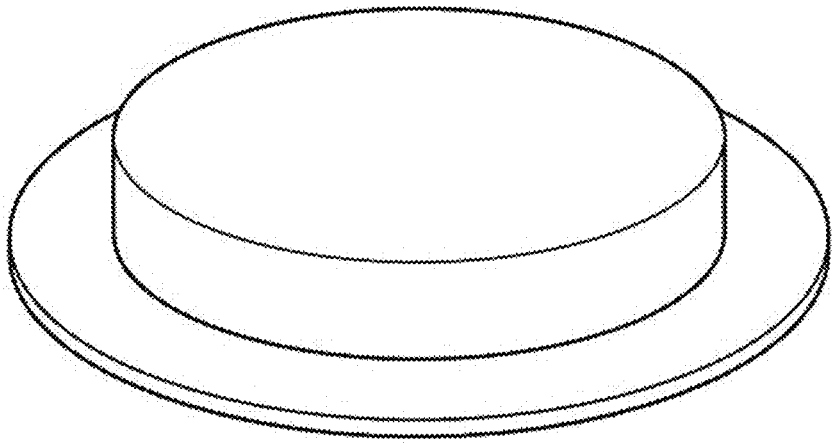

[Fig.8A]
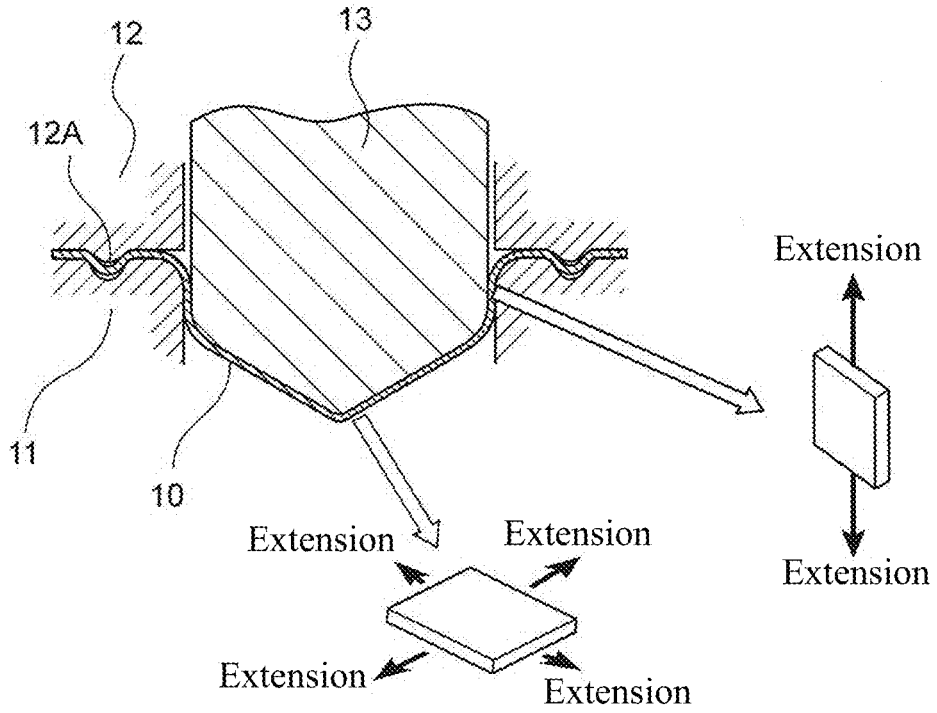
[Fig.8B]
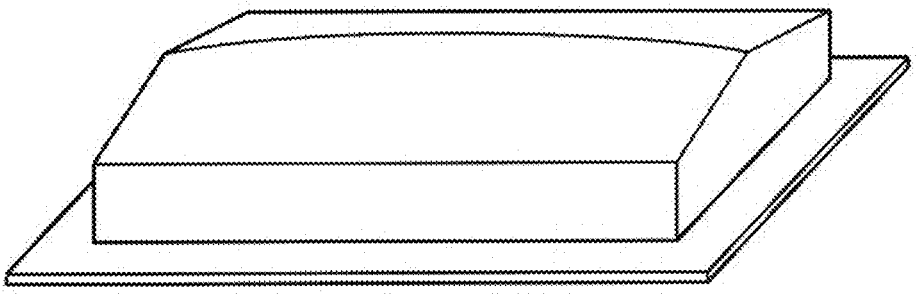

[Fig.9]
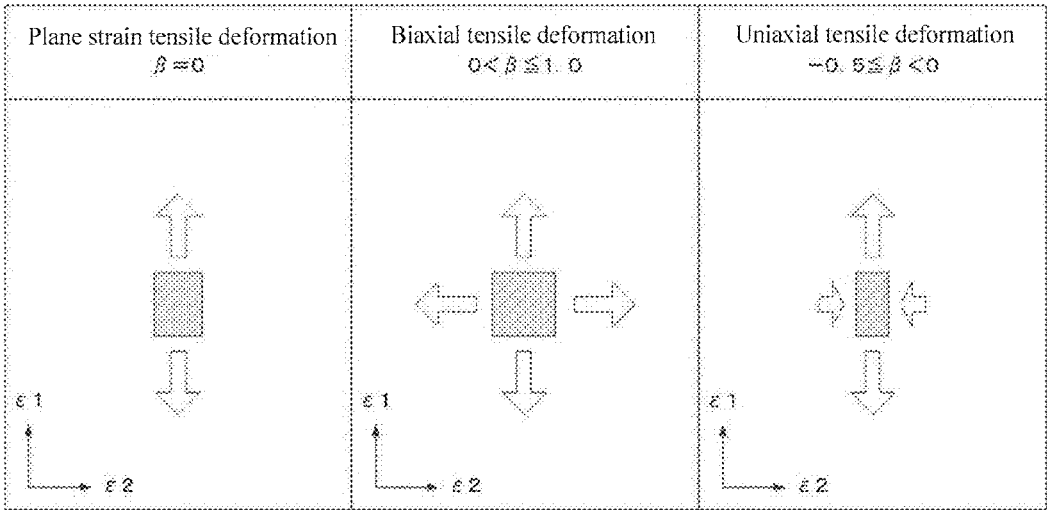
[Fig.10]
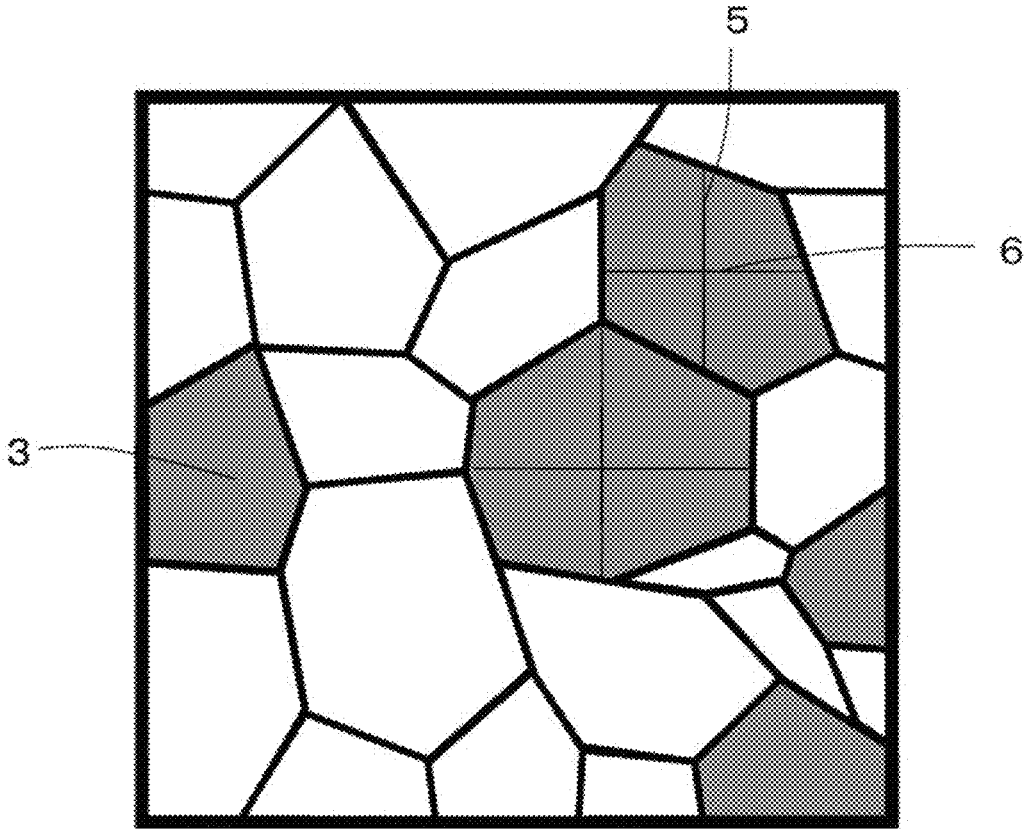

[Fig.11]
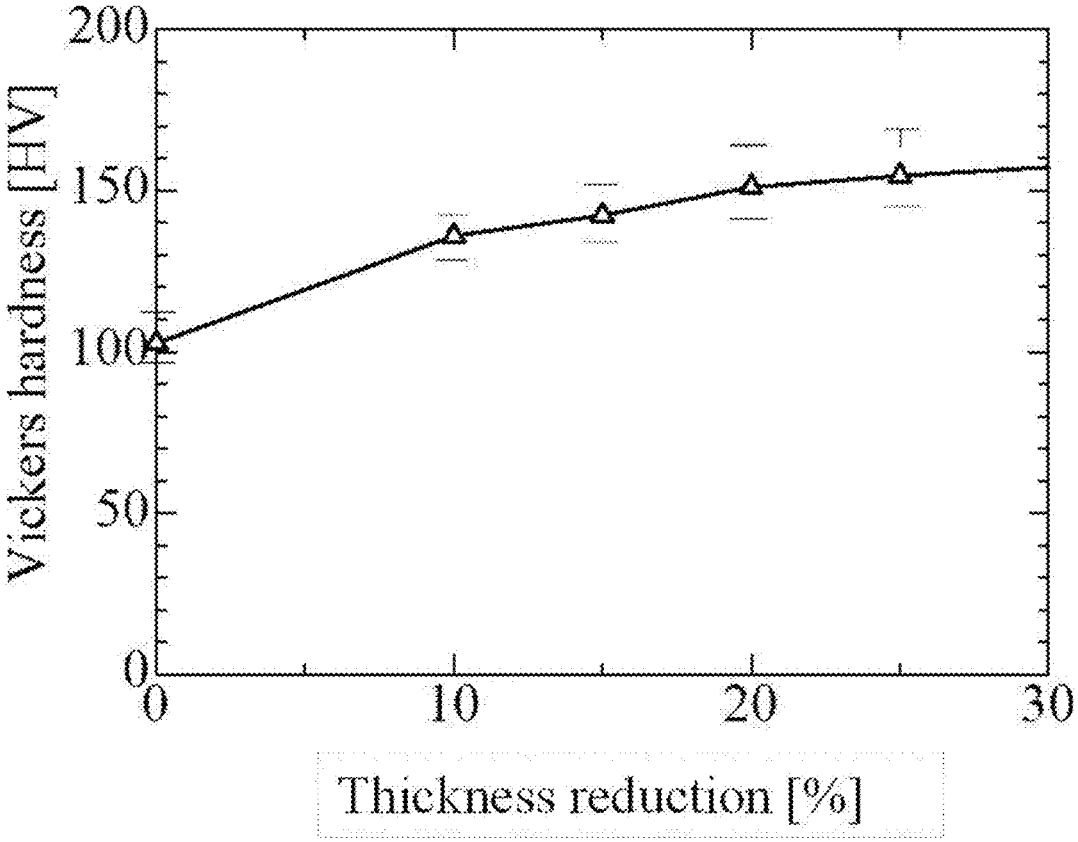

[Fig.12]
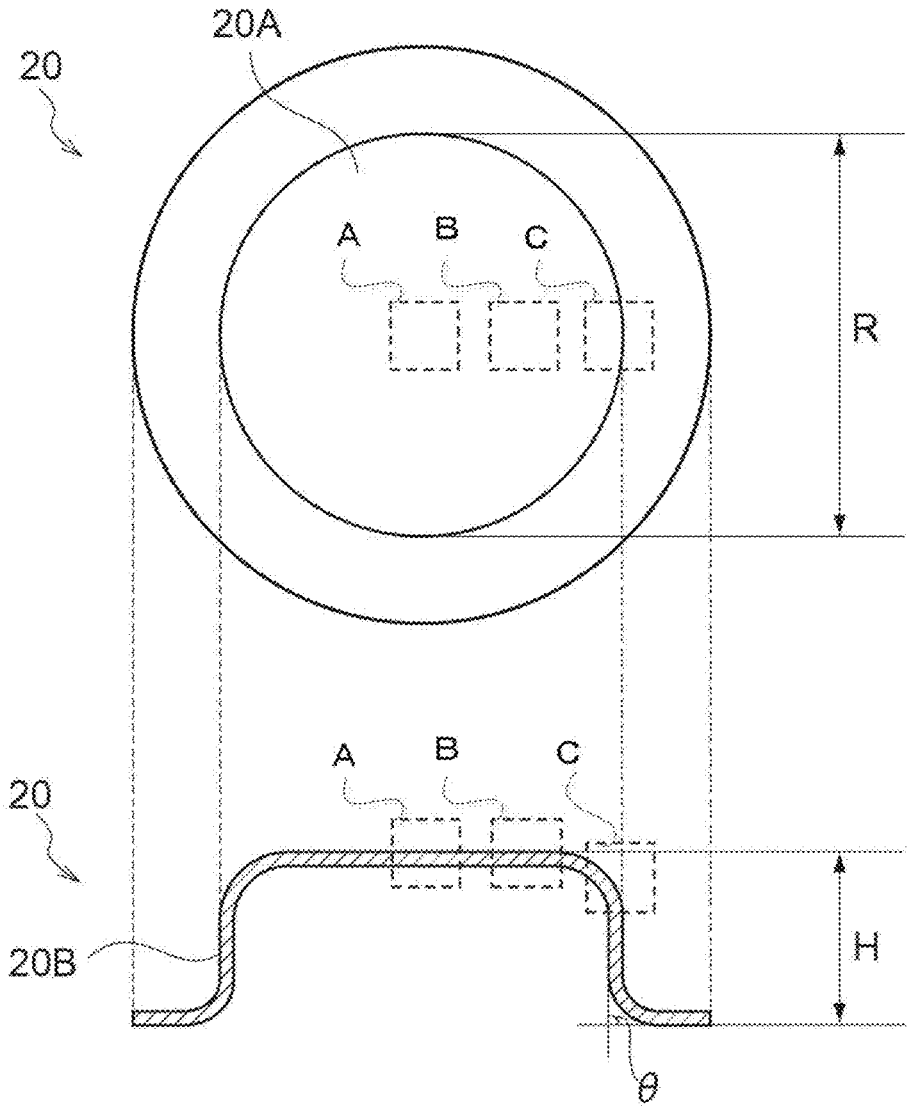

[Fig.13]
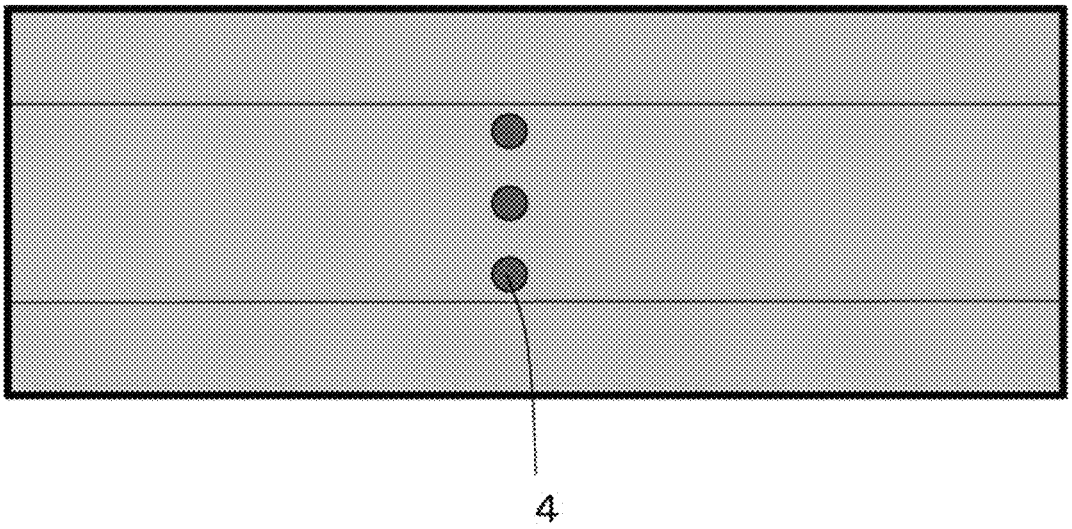

[Fig.14]
Cross-sectional micro-texture and surface protrusions and recesses of molded product No. 2 of the corresponding Example
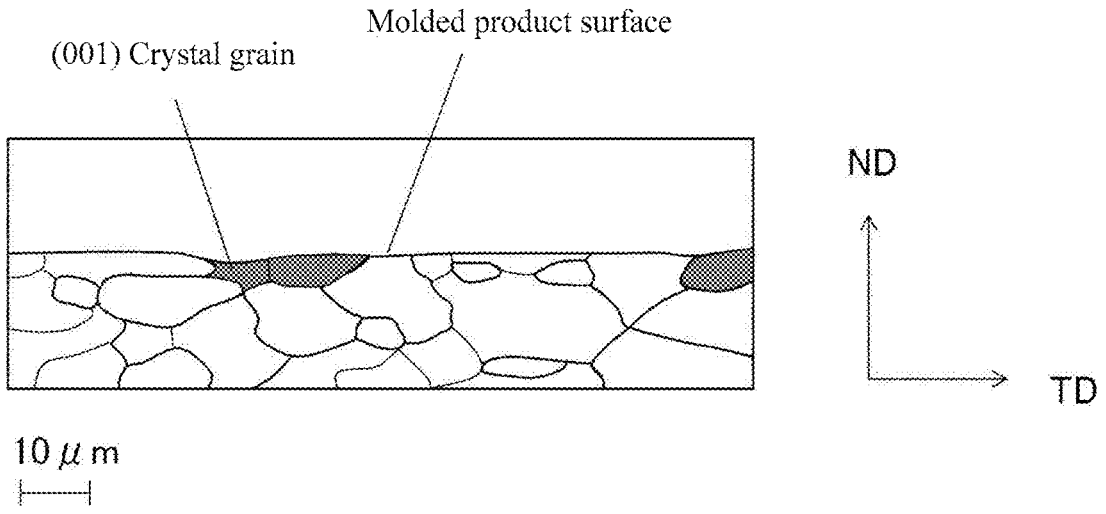
[Fig.15]
Cross-sectional micro-texture and surface protrusions and recesses of molded product No. 3 of the corresponding Example
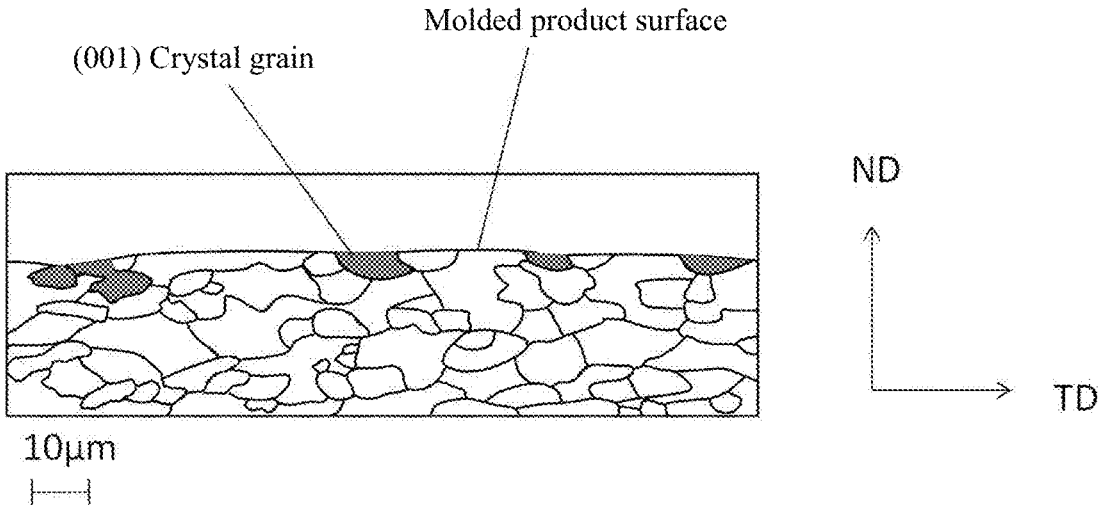

[Fig.16]
Cross-sectional micro-texture and surface protrusions and recesses of molded product No. 1 of the corresponding Comparative Example
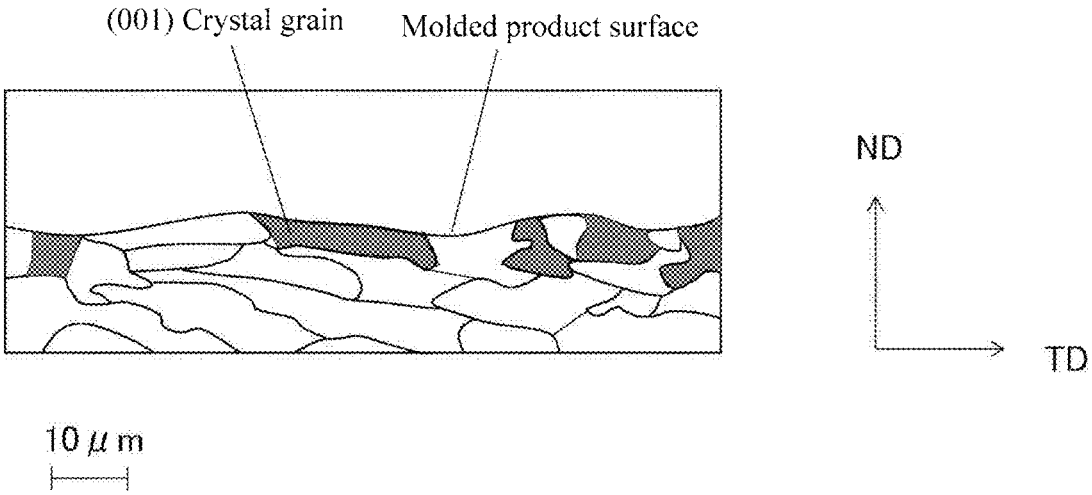
[Fig.17]
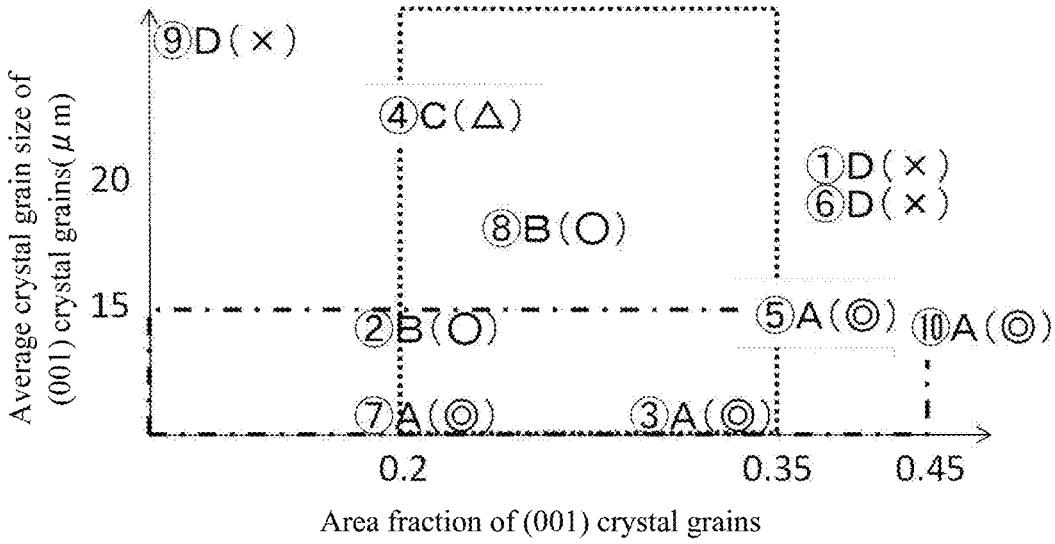

[Fig.18]
Cross-sectional micro-texture and surface protrusions and recesses of molded product No. 102 of the corresponding Example
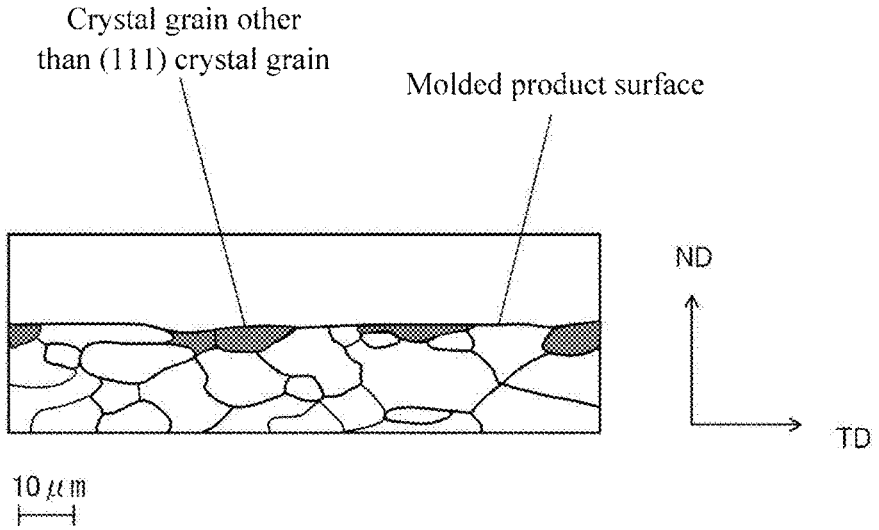
[Fig.19]
Cross-sectional micro-texture and surface protrusions and recesses of a molded product No. 103 of the corresponding Example
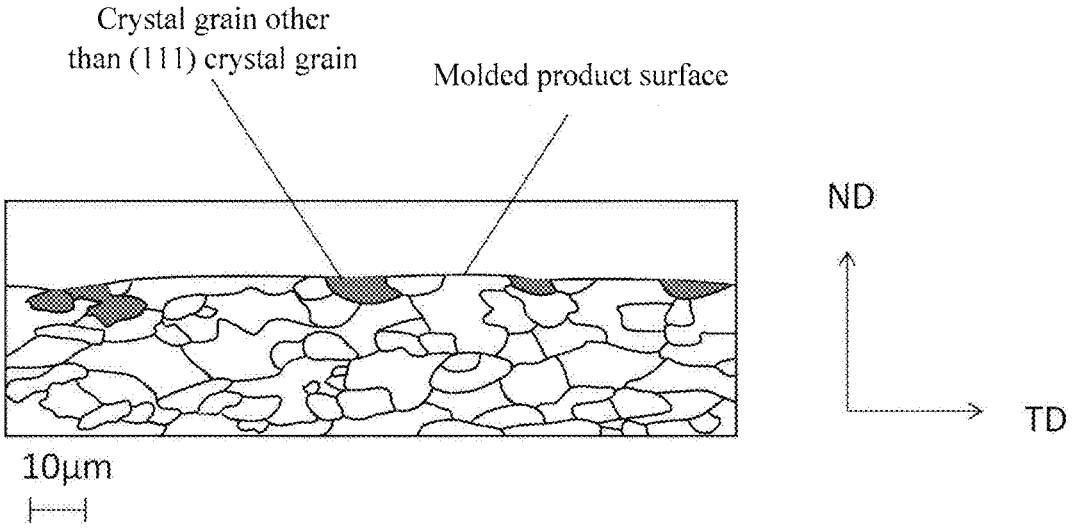

[Fig.20]
Cross-sectional micro-texture and surface protrusions and recesses of a molded product No. 101 of the corresponding Comparative Example
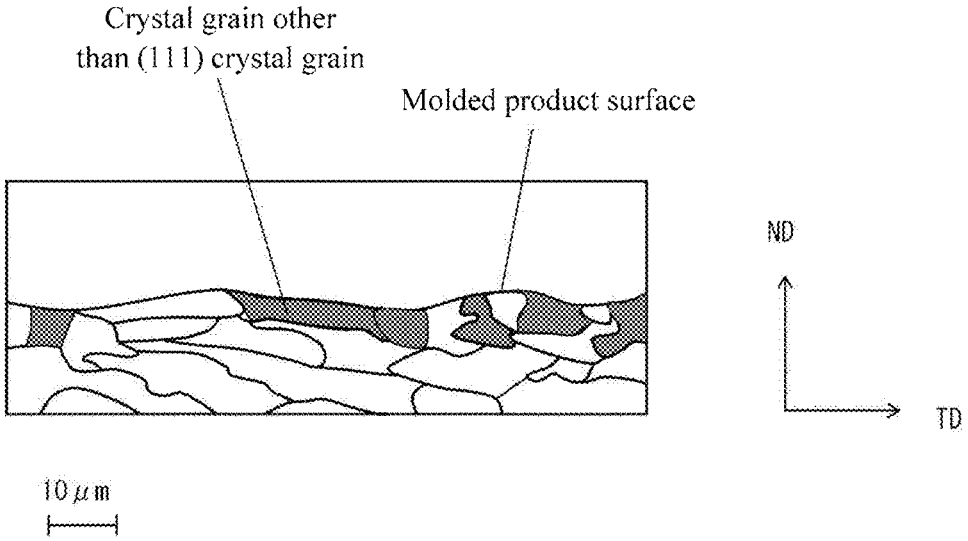

METHOD OF PRODUCING MOLDED PRODUCT AND MOLDED PRODUCT

TECHNICAL FIELD

The present disclosure relates to a method of producing a molded product and a molded product.

BACKGROUND ART

In recent years, in the fields of automobiles, aircraft, marine vessels, construction materials, home electric appliances, and the like, design is becoming more prioritized in order to respond to users' needs. This tends to make especially the shapes of exterior parts complicated. In order to mold a metal sheet into a molded product having a complicated shape, it is necessary to generate strain in a metal sheet. However, as the machining amount increases, fine protrusions and recesses are likely to be formed on the surface of a molded product, resulting in abnormal grain growth. This is problematic because excellent exterior appearance may be impaired.

For example, Patent Document 1 discloses that protrusions and recesses form a stripe pattern (ridging) in parallel to the rolling direction. Specifically, Patent Document 1 discloses the following. It is possible to obtain a rolled sheet of an aluminum alloy for molding, which has excellent ridging resistance by controlling an average Taylor factor determined when regarding that molding causes plane strain deformation in the rolling width direction that is the main strain direction. An average Taylor factor that is calculated based on all crystal orientations present in crystal texture is strongly related to ridging resistance. Ridging resistance can be stably improved with certainty by controlling crystal texture such that the average Taylor factor value satisfies specific conditions.

Patent Document 1: Japanese Patent No. 5683193

SUMMARY OF INVENTION

Problems to be Solved by the Invention

However, Patent Document 1 merely discloses that ridging can be inhibited upon molding of a metal sheet in which uniaxial tensile deformation occurs in the rolling width direction as the main strain direction. In addition, molding such as deep drawing molding or overhang molding of a metal sheet, which may cause plane strain tensile deformation and biaxial tensile deformation, is not considered.

Meanwhile, in recent years, there is a demand to produce a molded product having a complicated shape even in the case of molding such as deep drawing molding or overhang molding, which may cause plane strain tensile deformation and biaxial tensile deformation of a metal sheet. However, in fact, when molding is conducted for a metal sheet at a large machining amount (a machining amount corresponding to a sheet thickness decrease rate of 10% or more for a metal sheet), protrusions and recesses are formed on the surface of a molded product, which results in abnormal grain growth and impairment of excellent appearance. Similar problems are seen under current circumstances also in the case of molding of a metal sheet in which plane strain tensile deformation exclusively occurs.

For the above reasons, for example, conventional automobile exterior sheet products are produced at machining amounts within a limited scope in which the amount of distortion of a product face corresponds to a sheet thickness decrease rate of less than 10% for a metal sheet. In other words, processing conditions are limited in order to avoid the occurrence of abnormal grain growth. However, there is a demand for further complicated shapes of automobile exterior sheet products. A method that achieves a sheet thickness decrease rate of 10% or more for a metal sheet and inhibition of abnormal grain growth in a well-balanced manner upon molding has been awaited In consideration of the above, an object of one aspect of the disclosure is to provide a method of producing a molded product, by which a molded product that is excellent in design because of prevention of the occurrence of abnormal grain growth can be obtained even by treating a metal sheet having a bcc structure, and by molding the metal sheet to cause plane strain tensile deformation and/or biaxial tensile deformation and allowing at least a part of the metal sheet to have a sheet thickness decrease rate of from 10% to 30%.

In addition, an object of another aspect of the disclosure is to provide a molded product that is excellent in design because of prevention of the occurrence of abnormal grain growth, even when the molded product is a molded product of a metal sheet including a bcc structure, in which a shape of the molded product results from plane strain tensile deformation, or plane strain tensile deformation and biaxial tensile deformation, and a maximum sheet thickness and a minimum sheet thickness of the molded product are represented by D1 and D2, respectively, a formula $10 \leq (D1-D2)/D1 \times 100 \leq 30$ is satisfied, or a maximum hardness and a minimum hardness of the molded product are represented by H1 and H2, respectively, a formula $15 \leq (H1-H2)/H1 \times 100 \leq 40$ is satisfied.

Means for Solving the Problems

The inventors examined surface texture for molding of a metal sheet at a large machining amount (a machining amount corresponding to a sheet thickness decrease rate of 10% or more for a metal sheet) in order to produce a molded product having a complicated shape of a recent trend. As a result, the inventors obtained the following findings. When plane strain tensile deformation and biaxial tensile deformation occurs, crystal grains having a crystal orientation of 15° or less relative to a (001) plane parallel to the surface of a metal sheet having a bcc structure are deformed in a prioritized manner, and thus, protrusions and recesses are formed. Therefore, the present inventors focused on the area fraction and average crystal grain size of crystal grains having a crystal orientation of 15° or less relative to a (001) plane parallel to the surface of a metal sheet. As a result, the inventors found that it is possible to obtain a molded product that is excellent in design by controlling the area fraction and average crystal grain size of such crystal grains so as to inhibit the formation of protrusions and recesses, thereby inhibiting the occurrence of abnormal grain growth.

The inventors further obtained the following findings. When plane strain tensile deformation, or plane strain tensile deformation and biaxial tensile deformation occurs, crystal grains other than crystal grains having a crystal orientation of 15° or less relative to a (111) plane parallel to the surface of a metal sheet having a bcc structure are deformed in a prioritized manner, and thus, protrusions and recesses are formed. Therefore, the present inventors focused on the area fraction of crystal grains other than crystal grains having a crystal orientation of 15° or less relative to a (111) plane parallel to the surface of a metal sheet. As a result, the inventors found that it is possible to obtain a molded product that is excellent in design by controlling the area fraction of such crystal grains so as to inhibit the formation of protrusions and recesses, thereby inhibiting the occurrence of abnormal grain growth.

The disclosure is summarized as follows.

<1>

A method of producing a molded product, including:

treating a metal sheet having a bcc structure and a surface that satisfies either of the following conditions (a) or (b); and molding the metal sheet to cause plane strain tensile deformation and biaxial tensile deformation and allowing at least a part of the metal sheet to have a sheet thickness decrease rate of from 10% to 30%:

(a) an area fraction of crystal grains having a crystal orientation of 15° or less relative to a (001) plane parallel to the surface of the metal sheet is from 0.20 to 0.35;

(b) the area fraction of crystal grains having a crystal orientation of 15° or less relative to a (001) plane parallel to the surface of the metal sheet is 0.45 or less, and an average crystal grain size thereof is 15 μm or less.

<2>

A method of producing a molded product, including:

treating a metal sheet having a bcc structure and a surface that satisfies either of the following conditions (A) or (B); and molding the metal sheet to cause plane strain tensile deformation, or plane strain tensile deformation and biaxial tensile deformation and allowing at least a part of the metal sheet to have a sheet thickness decrease rate of from 10% to 30%:

(A) an area fraction of crystal grains other than crystal grains having a crystal orientation of 15° or less relative to a (111) plane parallel to the surface of the metal sheet is from 0.25 to 0.55;

(B) the area fraction of crystal grains other than crystal grains having a crystal orientation of 15° or less relative to a (111) plane parallel to the surface of the metal sheet is 0.55 or less, and an average crystal grain size thereof is 15 μm or less.

<3>

The method of producing a molded product according to <1> or <2>, wherein the metal sheet is a steel sheet.

<4>

The method of producing a molded product according to any one of <1> to <3>, wherein the metal sheet is a ferrite-based steel sheet having a metallic-structure ferrite fraction of 50% or more.

<5>

A molded product of a metal sheet including a bcc structure, wherein:

a shape of the molded product results from plane strain tensile deformation and biaxial tensile deformation;

a maximum sheet thickness and a minimum sheet thickness of the molded product are represented by D1 and D2, respectively, a formula $10 \leq (D1-D2)/D1 \times 100 \leq 30$ is satisfied; and a surface of the molded product satisfies either of the following conditions (c) or (d):

(c) an area fraction of crystal grains having a crystal orientation of 15° or less relative to a (001) plane parallel to the surface of the molded product is from 0.20 to 0.35;

(d) the area fraction of crystal grains having a crystal orientation of 15° or less relative to a (001) plane parallel to the surface of the molded product is 0.45 or less, and an average crystal grain size thereof is 15 μm or less.

<6>

A molded product of a metal sheet including a bcc structure, wherein:

a shape of the molded product results from plane strain tensile deformation, or plane strain tensile deformation and biaxial tensile deformation;

a maximum sheet thickness and a minimum sheet thickness of the molded product are represented by D1 and D2, respectively, a formula $10 \leq (D1-D2)/D1 \times 100 \leq 30$ is satisfied; and a surface of the molded product satisfies either of the following conditions (C) or (D):

(C) an area fraction of crystal grains other than crystal grains having a crystal orientation of 15° or less relative to a (111) plane parallel to the surface of the molded product is from 0.25 to 0.55;

(D) the area fraction of crystal grains other than crystal grains having a crystal orientation of 15° or less relative to a (111) plane parallel to the surface of the molded product is 0.55 or less, and an average crystal grain size thereof is 15 μm or less.

<7>

The molded product according to <5> or <6>, wherein the metal sheet is a steel sheet.

<8>

The molded product according to any one of <5> to <7>, wherein the metal sheet is a ferrite-based steel sheet having a metallic-structure ferrite fraction of 50% or more.

<9>

A molded product of a metal sheet including a bcc structure, wherein:

a shape of the molded product results from plane strain tensile deformation and biaxial tensile deformation;

a maximum hardness and a minimum hardness of the molded product are represented by H1 and H2, respectively, a formula $15 \leq (H1-H2)/H1 \times 100 \leq 40$ is satisfied; and a surface of the molded product satisfies either of the following conditions (c) or (d):

(c) an area fraction of crystal grains having a crystal orientation of 15° or less relative to a (001) plane parallel to the surface of the molded product is from 0.20 to 0.35;

(d) the area fraction of crystal grains having a crystal orientation of 15° or less relative to a (001) plane parallel to the surface of the molded product is 0.45 or less, and an average crystal grain size thereof is 15 μm or less.

<10>

A molded product of a metal sheet including a bcc structure, wherein:

a shape of the molded product results from plane strain tensile deformation, or plane strain tensile deformation and biaxial tensile deformation;

a maximum hardness and a minimum hardness of the molded product are represented by H1 and H2, respectively, a formula $15 \leq (H1-H2)/H1 \times 100 \leq 40$ is satisfied; and a surface of the molded product satisfies either of the following conditions (C) or (D):

(C) an area fraction of crystal grains other than crystal grains having a crystal orientation of 15° or less relative to a (111) plane parallel to the surface of the molded product is from 0.25 to 0.55;

(D) the area fraction of crystal grains other than crystal grains having a crystal orientation of 15° or less relative to a (111) plane parallel to the surface of the molded product is 0.55 or less, and an average crystal grain size thereof is 15 μm or less.

<11>

The molded product according to <9> or <10>, wherein the metal sheet is a steel sheet.

<12>

The molded product according to any one of <9> to <11>, wherein the metal sheet is a steel sheet having a metallic-structure ferrite fraction of 50% or more.

Effect of the Invention

According to one aspect of the disclosure, it is possible to provide a method of producing a molded product, by which a molded product that is excellent in design because of prevention of the occurrence of abnormal grain growth can be obtained even by treating a metal sheet having a bcc structure, and by molding the metal sheet to cause plane strain tensile deformation, or plane strain tensile deformation and biaxial tensile deformation and allowing at least a part of the metal sheet to have a sheet thickness decrease rate of from 10% to 30%.

According to another aspect of the disclosure, it is possible to provide a molded product that is excellent in design because of prevention of the occurrence of abnormal grain growth, even when the molded product is a molded product of a metal sheet including a bcc structure, in which a shape of the molded product results from plane strain tensile deformation, or plane strain tensile deformation and biaxial tensile deformation, in which given that the maximum sheet thickness and the minimum sheet thickness of the molded product are represented by D1 and D2, respectively, a formula $10 \leq (D1-D2)/D1 \times 100 \leq 30$ is satisfied, or given that the maximum hardness and the minimum hardness of the molded product are represented by H1 and H2, respectively, and a formula $15 \leq (H1-H2)/H1 \times 100 \leq 30$ is satisfied.

BRIEF DESCRIPTION OF DRAWINGS

FIG. 1 is an SEM observation image of the surface of a metal sheet examined by a Bulge forming test.

FIG. 2 is an SEM observation image of the surface of a metal sheet after further conducting electropolishing following a Bulge forming test.

FIG. 3A schematically illustrates analysis of the surface of a metal sheet in which formation of protrusions and recesses is less obvious after a Bulge forming test by the EBSD method.

FIG. 3B schematically illustrates protrusions and recesses on the surface of a metal sheet in an A1-A2 cross-section of FIG. 3A.

FIG. 4A schematically illustrates analysis of the surface of a metal sheet in which formation of protrusions and recesses is more obvious after a Bulge forming test by the EBSD method.

FIG. 4B schematically illustrates protrusions and recesses on the surface of a metal sheet in a B1-B2 cross-section of FIG. 4A.

FIG. 5A schematically illustrates analysis of the surface of a metal sheet in which formation of protrusions and recesses is more obvious after a Bulge forming test by the EBSD method.

FIG. 5B schematically illustrates protrusions and recesses on the surface of a metal sheet in a C1-C2 cross-section of FIG. 5A.

FIG. 6 schematically explains the definition of the expression "crystal grains having a crystal orientation of 15° or less relative to a (001) plane parallel to a surface of the metal sheet."

FIG. 7A schematically illustrates one example of overhang molding.

FIG. 7B schematically illustrates one example of a molded product obtained by overhang molding illustrated in FIG. 7A.

FIG. 8A schematically illustrates one example of drawing overhang molding.

FIG. 8B schematically illustrates one example of a molded product obtained by drawing overhang molding illustrated in FIG. 8A.

FIG. 9 schematically explains plane strain tensile deformation, biaxial tensile deformation, and uniaxial tensile deformation.

FIG. 10 schematically illustrates a method of calculating the average crystal grain size of (001) crystal grains based on analysis results of the EBSD method.

FIG. 11 is a graph indicating a relationship between the sheet thickness decrease rate and work hardness for molding.

FIG. 12 schematically explains the molded product produced in the Examples.

FIG. 13 schematically illustrates an observational view of a steel sheet from the top.

FIG. 14 schematically illustrates cross-sectional microtexture of a molded product No. 2 of the corresponding Example and surface protrusions and recesses thereof.

FIG. 15 schematically illustrates cross-sectional microtexture of a molded product No. 3 of the corresponding Example and surface protrusions and recesses thereof.

FIG. 16 schematically illustrates cross-sectional microtexture of a molded product No. 1 of the corresponding Comparative Example and surface protrusions and recesses thereof.

FIG. 17 illustrates visual observation evaluation results and a relationship between the average crystal grain size and the area fraction of (001) crystal grains for the molded product obtained in the first Example.

FIG. 18 schematically illustrates cross-sectional microtexture of a molded product No. 102 of the corresponding Example and surface protrusions and recesses thereof.

FIG. 19 schematically illustrates cross-sectional microtexture of a molded product No. 103 of the corresponding Example and surface protrusions and recesses thereof.

FIG. 20 schematically illustrates cross-sectional microtexture of a molded product No. 101 of the corresponding Comparative Example and surface protrusions and recesses thereof.

DESCRIPTION OF EMBODIMENTS

Hereinafter, some aspects of the disclosure are described in detail with reference to the drawings. Identical reference numerals are given to the same or corresponding portions and the description thereof will not be repeated in the drawings.

(Method of Producing Molded Product)

The inventors made various studies on the metallic structure of metal sheets to be treated by molding. As a result, the following findings were obtained.

(1) In a metal sheet having a bcc structure, the (001) plane is more susceptible to stress due to equi-biaxial tensile deformation and non-equi-biaxial tensile deformation similar to equi-biaxial tensile deformation than the (111) plane. In addition, the (101) plane is more susceptible to stress due to equi-biaxial tensile deformation and non-equi-biaxial tensile deformation similar to equi-biaxial tensile deformation than the (111) plane. Therefore, in a case in which molding of a metal sheet such as deep drawing molding or overhang molding, which causes plane strain tensile deformation and biaxial tensile deformation, is conducted at a large machining amount (a machining amount that results in a sheet thickness decrease rate of from 10% to 30% for at least a part of the metal sheet), strain is concentrated in crystal grains having a crystal orientation of 15° relative to a (001) plane parallel to the surface of a metal sheet.

(2) Strain concentrated in crystal grains having a crystal orientation of 15° relative to a (001) plane parallel to the surface of a metal sheet causes development of the surface of the metal sheet, which results in deterioration of surface texture (i.e., the occurrence of abnormal grain growth).

(3) When protrusions and recesses developed on the surface of a metal sheet are connected, it further accelerates deterioration of surface texture (i.e., the occurrence of obvious abnormal grain growth).

(4) Even in a case in which there are excessively few crystal grains having a crystal orientation of 15° relative to a (001) plane parallel to the surface of a metal sheet, localized deformation occurs in a distributed manner in crystal grains having a crystal orientation of about 15° relative to a (001) plane parallel to the surface of a metal sheet (e.g., crystal grains having a crystal orientation of from more than 15° to 30° relative to a (001) plane). This causes the development of protrusions and recesses on the surface of a metal sheet.

FIG. 1 is a scanning electron microscope (SEM) observation image of the surface of a metal sheet examined by the Bulge forming test. FIG. 2 is an SEM observation image of the surface of a metal sheet after further conducting electropolishing following a Bulge forming test. In both FIGS. 1 and 2, the observational point is an apex of a metal sheet that is bulging to form a mountain shape as a result of the Bulge forming test. When a metal sheet was examined by the Bulge forming test with reference to FIGS. 1 and 2, recesses 1 and 2 having sizes of from about 10 to 20 μm were observed.

In other words, overhang molding of a metal sheet causes stress to be concentrated at a certain point of the metal sheet. At the site where stress has been concentrated, protrusions and recesses are formed on the surface of the metal sheet. In addition, the formed protrusions and recesses are connected, thereby further developing protrusions and recesses to be formed. Thus, protrusions and recesses cause abnormal grain growth to occur.

FIGS. 3A to 5A each schematically illustrate analysis of the surface of a metal sheet examined by the Bulge forming test by the electron back scattering diffraction (EBSD) method. FIG. 3A schematically illustrates a metal sheet, on the surface of which obvious formation of protrusions and recesses has not occurred in a case in which the overhang height is set to 40 mm for Bulge forming (corresponding to molding which allows at least a part of a metal sheet to have a sheet thickness decrease rate of 25%). FIGS. 4A and 5A each schematically illustrate a metal sheet, on the surface of which obvious formation of protrusions and recesses has occurred in a case in which the overhang height is set to 40 mm for Bulge forming (corresponding to molding which allows at least a part of a metal sheet to have a sheet thickness decrease rate of 25%).

FIGS. 3B to 5B schematically illustrate protrusions and recesses of the surface of a metal sheet in the cross-section in each of FIGS. 3A to 5A.

In other words, FIG. 3B schematically illustrates a cross-section of protrusions and recesses on the surface of a metal sheet, on which obvious formation of protrusions and recesses has not occurred. FIGS. 4B and 5B each schematically illustrate a metal sheet, on the surface of which obvious formation of protrusions and recesses has occurred.

Among crystal grains in FIGS. 3A to 5A, each dark gray crystal grain 3 is a crystal grain having a crystal orientation of 15° or less relative to a (001) plane parallel to a surface of a metal sheet. Such crystal grain is hereinafter also referred to as a "(001) crystal grain." Among crystal grains in FIGS. 3A to 5A, each pale gray crystal grain 4 is a crystal grain having a crystal orientation of about 15° relative to a (001) plane parallel to a surface of a metal sheet (e.g., a crystal grain having a crystal orientation of from more than 15° to 20° relative to the (001) plane). Such crystal grain is hereinafter also referred to as a "(001) adjacent crystal grain." A numerical reference 31 denotes a surface of a metal sheet on which (001) crystal grains 3 exist in FIGS. 3B to 5B. In addition, a numerical reference 41 denotes a surface of a metal sheet on which (001) adjacent crystal grains 4 exist.

It was found that the area fraction of (001) crystal grains 3 is from 0.20 to 0.35 on a surface of a metal sheet, on which obvious formation of protrusions and recesses has not occurred, with reference to FIGS. 3A and 3B.

It was found that the area fraction of (001) crystal grains 3 is less than 0.20 or more than 0.35 on a surface of a metal sheet, on which obvious formation of protrusions and recesses has occurred, with reference to FIGS. 4A and 5A and FIG. 4B and FIG. 5B This is because strain is concentrated in (001) crystal grains 3 upon overhang molding. Strain concentrated in (001) crystal grains 3 causes formation of protrusions and recesses on the surface of a metal sheet. Further, when the area fraction of (001) crystal grains 3 is high, the probability that (001) crystal grains 3 are in contact with each other increases, which facilitates the formed protrusions and recesses to be connected with each other. Meanwhile, when the area fraction of (001) crystal grains 3 is excessively low, localized deformation of (001) adjacent crystal grains 4 occurs in a distributed manner, which allows protrusions and recesses to form on a surface of a metal sheet.

Specifically, in a case in which the area fraction of (001) crystal grains 3 is in an appropriate range, localized deformation of (001) adjacent crystal grains 4 does not occur in a distributed manner on a surface of a metal sheet. This results in localized deformation of (001) crystal grains 3 alone. Accordingly, deep recesses are formed in a region where (001) crystal grains 3 exist while formation of flat portions is ensured in a region where other crystal grains (e.g., (001) adjacent crystal grains 4) exist (see FIG. 3B). This indicates that even in a case in which high protrusions and deep recesses are formed, formation of flat portions can be ensured as long as deep and fine recesses are formed.

Meanwhile, in a case in which the area fraction of (001) crystal grains 3 is excessively low, localized deformation of (001) adjacent crystal grains 4 occurs in a distributed manner on a surface of a metal sheet. This causes localized deformation of (001) adjacent crystal grains 4 as well as (001) crystal grains 3. Accordingly, a region where shallow recesses are formed is enlarged, which results in relatively fewer flat portions (see FIG. 4B).

In addition, in a case in which the area fraction of (001) crystal grains 3 is excessively high, localized deformation of (001) crystal grains 3 occurs on a surface of a metal sheet, and a region where shallow recesses are formed is enlarged, which results in fewer flat portions (FIG. 5B).

This means that either an excessively high or low area fraction of (001) crystal grains 3 causes formation of protrusions and recesses on a surface of a steel sheet and facilitates the formed protrusions and recesses to be connected to each other, and such connection causes further formation of protrusions and recesses.

The inventors therefore considered that in a case in which molding that causes plane strain tensile deformation and biaxial tensile deformation is conducted, it is possible to inhibit formation of protrusions and recesses on a surface of a metal sheet by setting the proportion of (001) crystal grains 3 within a given range. In other words, it is possible to inhibit abnormal grain growth that impairs the excellent appearance of a molded product by inhibiting formation of protrusions and recesses.

Meanwhile, the inventors considered that in a case in which the proportion of (001) crystal grains 3 is low, even when formation of protrusions and recesses on the surface of a metal sheet occurs during processing, protrusions and recesses formed on a surface of a metal sheet are less obvious, and thus, the formation is unlikely to be recognized as abnormal grain growth that impairs the excellent appearance of a molded product, provided that sizes of (001) crystal grains 3 are sufficiently small.

The first method of producing a molded product of the disclosure, which has been completed based on the above findings, is a method of producing a molded product, which includes treating a metal sheet having a bcc structure and a surface that satisfies either of the following conditions (a) or (b), and molding the metal sheet to cause plane strain tensile deformation and biaxial tensile deformation and allowing at least a part of the metal sheet to have a sheet thickness decrease rate of from 10% to 30%:

(a) the area fraction of crystal grains having a crystal orientation of 15° or less relative to a (001) plane parallel to a surface of the metal sheet is from 0.20 to 0.35;

(b) the area fraction of crystal grains having a crystal orientation of 15° or less relative to a (001) plane parallel to a surface of the metal sheet is 0.45 or less, and the average crystal grain size thereof is 15 μm or less.

According to the first method of producing a molded product of the disclosure, a molded product that is excellent in design because of prevention of the occurrence of abnormal grain growth can be obtained even by treating a metal sheet having a bcc structure by molding the metal sheet to cause plane strain tensile deformation and biaxial tensile deformation and allowing at least a part of the metal sheet to have a sheet thickness decrease rate of from 10% to 30%.

The expression "crystal grains having a crystal orientation of 15° or less relative to a (001) plane parallel to a surface of the metal sheet" used herein means crystal grains having a crystal orientation within a range from a crystal orientation 3B that is inclined with a sharp angle of 15° relative to a (001) plane 3A on one face of a metal sheet to a crystal orientation 3C that is inclined with a sharp angle of 15° relative to a (001) plane 3A on the other face of a metal sheet as illustrated in FIG. 6. In other words, such crystal grains are crystal grains having a crystal orientation within a range of angle θ formed between the crystal orientation 3B and the crystal orientation 3C.

Meanwhile, the inventors further examined the metallic structure of a metal sheet to be treated by molding based on the above-described findings. Then, the inventors investigated a relationship between a crystal orientation of crystal grains and abnormal grain growth of a molded product in a plane strain tensile deformation field and a non-equi-biaxial tensile deformation field similar to the plane strain deformation field. As a result, the inventors obtained the following findings. In an equi-biaxial tensile deformation field and a non-equi-biaxial tensile deformation field similar to the equi-biaxial tensile deformation field, strain is concentrated in (001) crystal grains 3, which results in prioritized deformation. Meanwhile, in a plane strain tensile deformation field and a non-equi-biaxial tensile deformation field similar to the plane strain deformation field, strain is concentrated in not only (001) crystal grains 3 but also crystal grains other than crystal grains having a crystal orientation of 15° or less relative to a (111) plane parallel to the surface of a metal sheet (hereinafter also referred to as "(111) crystal grains"), which results in prioritized deformation.

In other words, the inventors considered as follows. In a case in which molding that causes plane strain tensile deformation, or plane strain tensile deformation and biaxial tensile deformation is conducted, it is possible to inhibit formation of protrusions and recesses on a surface of a metal sheet by setting the proportion of crystal grains other than (111) crystal grains within a given range. In other words, it is possible to inhibit abnormal grain growth that impairs the excellent appearance of a molded product by inhibiting formation of protrusions and recesses.

Further, the inventors considered as follows. In a case in which the proportion of crystal grains other than (111) crystal grains is low, even when formation of protrusions and recesses on a surface of a metal sheet occurs during processing, protrusions and recesses formed on the surface of a metal sheet are less obvious, and thus, the formation is unlikely to be recognized as abnormal grain growth that impairs the excellent appearance of a molded product, provided that sizes of crystal grains other than (111) crystal grains 3 are sufficiently small.

The second method of producing a molded product of the disclosure, which has been completed based on the above findings, is a method of producing a molded product, which includes treating a metal sheet having a bcc structure and a surface that satisfies either of the following condition (A) or (B), and molding the metal sheet to cause plane strain tensile deformation, or plane strain tensile deformation and biaxial tensile deformation and allowing at least a part of the metal sheet to have a sheet thickness decrease rate of from 10% to 30%:

(A) the area fraction of crystal grains other than crystal grains having a crystal orientation of 15° or less relative to a (111) plane parallel to a surface of the metal sheet is from 0.25 to 0.55;

(B) the area fraction of crystal grains other than crystal grains having a crystal orientation of 15° or less relative to a (111) plane parallel to a surface of the metal sheet is 0.55 or less, and the average crystal grain size thereof is 15 μm or less.

According to the second method of producing a molded product of the disclosure, a molded product that is excellent in design because of prevention of the occurrence of abnormal grain growth can be obtained even by treating a metal sheet having a bcc structure by molding the metal sheet to cause plane strain tensile deformation, or plane strain tensile deformation and biaxial tensile deformation and allowing at least a part of the metal sheet to have a sheet thickness decrease rate of from 10% to 30%.

The expression "crystal grains having a crystal orientation of 15° or less relative to a (111) plane parallel to a surface of the metal sheet" used herein means crystal grains having a crystal orientation within a range from a crystal orientation that is inclined with a sharp angle of 15° relative to a (111) plane on one face of a metal sheet to a crystal orientation that is inclined with a sharp angle of 15° relative to a (001) plane on the other face of a metal sheet. In other words, such crystal grains are crystal grains having a crystal orientation within a range of angle θ formed between these two crystal orientations.

(Molding)

A metal sheet is treated by molding that causes plane strain tensile deformation, or plane strain tensile deformation and biaxial tensile deformation. Examples of molding include deep drawing molding, overhang molding, drawing overhang molding, and bending molding. Specifically, molding is, for example, a method of treating a metal sheet 10 by overhang molding as illustrated in FIG. 7A. Upon such molding, an edge portion of a metal sheet 10 is sandwiched between a die 11 and a holder 12 provided with a drawbead 12A. Thus, the drawbead 12A is engaged with the surface of the edge portion of the metal sheet 10 such that the metal sheet 10 is in a state of being fixed. The metal sheet 10 in such state is pressed by a punch 13 having a flat top face, thereby treating the metal sheet 10 by overhang molding. FIG. 7B illustrates one example of a molded product obtained by overhang molding illustrated in FIG. 7A. In the case of overhang molding illustrated in FIG. 7A, plane strain deformation occurs on, for example, a metal sheet 10 positioned on the lateral side of a punch 13 (corresponding to a portion on the lateral side of a molded product). Meanwhile, equi-biaxial deformation or non-equi-biaxial tensile deformation relatively close to equi-biaxial deformation occurs on the metal sheet 10 positioned on the top face of the punch 13 (corresponding to the top face of a molded product).

In addition, one example method of molding is a method of treating a metal sheet 10 by overhang molding as illustrated in FIG. 8A. Upon such molding, an edge portion of a metal sheet 10 is sandwiched between a die 11 and a holder 12 provided with a drawbead 12A. Thus, the drawbead 12A is engaged with the surface of the edge portion of the metal sheet 10 such that the metal sheet 10 is in a state of being fixed. Then, the metal sheet 10 in such state is pressed by a punch 13 having a top face that protrudes in an approximate V shape, thereby treating the metal sheet 10 by drawing overhang molding. FIG. 8B illustrates one example of a molded product obtained by drawing overhang molding illustrated in FIG. 8A. In the case of drawing overhang molding illustrated in FIG. 8A, plane strain deformation occurs on, for example, a metal sheet 10 positioned on the lateral side of a punch 13 (corresponding to a portion on the lateral side of a molded product). Meanwhile, non-equi-biaxial tensile deformation relatively similar to equi-biaxial deformation occurs on the metal sheet 10 positioned on the top face of the punch 13 (corresponding to the top face of a molded product).

As illustrated in FIG. 9, plane strain tensile deformation is a mode of deformation that causes extension in the ε1 direction but not in the ε2 direction. In addition, biaxial tensile deformation is a mode of deformation that causes extension in both the ε1 direction and the ε2 direction. Specifically, plane strain tensile deformation is a mode of deformation on the condition that given that strains in the biaxial directions are designated as the maximum main strain ε1 and the minimum main strain ε2, the strain ratio $\beta(=\varepsilon2/\varepsilon1)$ is $\beta=0$. Biaxial tensile deformation is a mode of deformation on the condition that the strain ratio $\beta(=\varepsilon2/\varepsilon1)$ is $0<\beta\leq1$. In addition, non-equi-biaxial deformation is a mode of deformation on the condition that the strain ratio $\beta(=\varepsilon2/\varepsilon1)$ is $0<\beta<1$, and equi-biaxial deformation is a mode of deformation on the condition that the strain ratio $\beta(=\varepsilon2/\varepsilon1)$ is $\beta=1$. Note that uniaxial tensile deformation is a mode of deformation that causes extension in the ε1 direction while causing shrinkage in the ε2 direction on the condition that the strain ratio $\beta(=\varepsilon2/\varepsilon1)$ is $-0.5\leq\beta<0$.

Note that the above-described strain ratio β is within a range of theoretical values. For example, the range of strain ratio β for each mode of deformation, which is calculated based on the maximum main strain and the minimum main strain determined from changes in the shapes of scribed circles transferred to a surface of a steel sheet before and after steel sheet molding (before and after steel sheet deformation), is described below.

Uniaxial tensile deformation: $-0.5<\beta\leq-0.1$

Plane strain tensile deformation: $-0.1<\beta\leq0.1$

Non-equi-biaxial deformation: $0.1<\beta\leq0.8$

Equi-biaxial deformation: $0.8<\beta\leq1.0$

Meanwhile, molding is conducted at a machining amount that causes at least a portion of a metal sheet to have a sheet thickness decrease rate of from 10% to 30%. At a machining amount that results in a sheet thickness decrease rate of less than 10%, there is a tendency that strain is less likely to be concentrated in crystal grains (especially (001) crystal grains) other than (111) crystal grains, which makes it difficult to cause formation of protrusions and recesses upon molding. Therefore, even when a metal sheet does not satisfy the conditions (a) and (b) or the conditions (A) and (B) described above, abnormal grain growth of a molded product itself is unlikely to occur. Meanwhile, when the sheet thickness decrease rate exceeds 30%, there is an increased tendency that molding causes fracture of a metal sheet (molded product). Therefore, the machining amount of molding is set to fall within the above-described range.

Molding is conducted at a machining amount that causes at least a portion of a metal sheet to have a sheet thickness decrease rate of from 10% to 30%. However, molding may be conducted at a machining amount that causes the entire metal sheet excluding an edge portion (a portion sandwiched between a die and a holder) to have a sheet thickness decrease rate of from 10% to 30%. It is particularly preferable to conduct molding at a machining amount that causes a portion of a metal sheet which is positioned on the top face of a punch (a portion of a metal sheet to be treated by biaxial tensile deformation) to have a sheet thickness decrease rate of from 10% to 30%, although it depends on the shape of a molded product obtained by molding. A portion of a metal sheet which is positioned on the top face of a punch is likely to be seen in a case in which a molded product is used as an exterior member. For such reason, when this portion of a metal sheet is treated by molding at a large machining amount corresponding to a sheet thickness decrease rate of from 10% to 30%, significant effects of inhibiting abnormal grain growth can be obtained by inhibiting formation of protrusions and recesses.

Given that the sheet thickness of a metal sheet before molding is represented by Ti and sheet thickness of a metal sheet after molding (molded product) is represented by Ta, the sheet thickness decrease rate is expressed by the following formula: sheet thickness decrease rate=(Ti−Ta)/Ti.

(Metal Sheet)

[Type]

A metal sheet used herein is a metal sheet having a bcc structure (body-centered cubic lattice structure). A metal sheet having a bcc structure is preferably a metal sheet of α-Fe, Li, Na, K, β-Ti, V, Cr, Ta, W, or the like. Of these, in view of the easiest procurement for producing a structured object, steel sheets (e.g., ferrite-based steel sheets, bainite steel sheet s of bainite single phase texture, and martensite steel sheets of martensite single phase texture) are preferable, and ferrite-based steel sheets are more preferable.

Ferrite steel sheets also include steel sheets containing martensite and bainite (DP steel sheets) as well as steel sheets having a metallic-structure ferrite fraction of 100%.

The metallic-structure ferrite fraction of a ferrite-based steel sheet is preferably 50% or more and more preferably 80% or more. In a case in which the metallic-structure ferrite fraction is less than 80%, the influence of hard phase increases. Further, in a case in which it is less than 50%, the hard phase becomes dominant, the influence of the crystal orientation of ferrite (crystal grains (especially (001) crystal grains) other than (111) crystal grains) decreases. Therefore, formation of protrusions and recesses tends not to occur upon molding, which makes it difficult to cause abnormal grain growth itself of a molded product to occur. Accordingly, significant effects of inhibiting abnormal grain growth can be obtained with the use of a ferrite-based steel sheet having a ferrite fraction within the above range.

The ferrite fraction can be determined by the method described below. A surface of a steel sheet is polished and then immersed in a nital solution, thereby allowing ferrite structure to be exposed. The structure is photographed using an optical microscope. Then, the ferrite structure area with respect to the entire area of the photo of the structure is calculated.

Thickness of a metal sheet is not particularly limited. However, it is preferably 3 mm or less in view of moldability.

[(001) Crystal Grain]

In a case in which molding that causes plane strain tensile deformation and biaxial tensile deformation is conducted, crystal grains having a crystal orientation of 15° or less relative to a (001) plane parallel to the surface of a metal sheet ((001) crystal grains) satisfy either of the following (a) or (b) on the surface of a metal sheet:

(a) the area fraction of (001) crystal grains is from 0.20 to 0.35; and (b) the area fraction of (001) crystal grains is 0.45 or less, and the average crystal grain size thereof is 15 μm or less.

As stated above, in the case of a metal sheet having a bcc structure, (001) crystal grains are most susceptible to stress due to equi-biaxial tensile deformation and non-equi-biaxial tensile deformation similar to equi-biaxial tensile deformation. Therefore, in a case in which molding of a metal sheet such as deep drawing molding or overhang molding, which causes plane strain tensile deformation and biaxial tensile deformation, is conducted at a large machining amount (a machining amount that results in a sheet thickness decrease rate of from 10% to 30% for at least a part of the metal sheet), strain is likely to be concentrated on (001) crystal grains, which facilitates formation of protrusions and recesses on (001) crystal grains. In addition, in a case in which the proportion of (001) crystal grains is large, strain is likely to be concentrated, which facilitates formation of protrusions and recesses. Meanwhile, in a case in which the proportion of (001) crystal grains is small, there are few portions on which strain is concentrated, and localized deformation occurs in a distributed manner also in (001) adjacent crystal grains, which, in turn, facilitates formation of protrusions and recesses. Note that, also in a case in which the proportion of (001) crystal grains is small, when the size of (001) crystal grains is sufficiently small, a region of localized deformation of (001) adjacent crystal grains also becomes small. This results in formation of fine protrusions and recesses, which is unlikely to be regarded as abnormal grain growth of a molded product.

Therefore, in a case in which a metal sheet satisfies (a) described above, adequate concentration of strain due to molding is achieved. Accordingly, formation of protrusions and recesses is inhibited, thereby inhibiting abnormal grain growth of a molded product. Meanwhile, in a case in which a metal sheet satisfies (b) described above, adequate concentration of strain due to molding is achieved with an area fraction of (001) crystal grains within a range of from 0.20 to 0.45. In a case in which the area fraction of (001) crystal grains is less than 0.20, formation of protrusions and recesses is unlikely to be regarded as abnormal grain growth of a molded product. Accordingly, abnormal grain growth of a molded product is inhibited.

In addition, the average crystal grain size of (001) crystal grains is 15 μm or less on the condition (b). However, in view of inhibition of abnormal grain growth, it is preferably 10 μm or less. Although a smaller average crystal grain size of (001) crystal grains is more preferable in terms of inhibition of abnormal grain growth, the average crystal grain size is preferably 1 μm or more. This is because since the orientation is controlled by recrystallization, it is difficult to achieve drastic reduction of the crystal grain size and orientation control in a well-balanced manner.

The average crystal grain size of (001) crystal grains is measured by the following method. A surface of a metal sheet is observed using SEM and measurement regions are arbitrarily selected. (001) crystal grains are selected for each measurement region using the EBSD method. Two test lines are drawn on each of the selected (001) crystal grains. The arithmetic average of the two test lines is calculated to obtain the average crystal grain size of (001) crystal grains. Specifically, the method is as follows. FIG. 10 schematically illustrates a method of calculating the average crystal grain size based on analysis results of the EBSD method. A test line 5 that passes the center of each (001) crystal grain 3 is drawn such that test lines 5 are aligned in the same direction for all (001) crystal grains 3 with reference to FIG. 10. Further, a test line 6 that passes the center of each (001) crystal grain 3 is drawn such that each test line 6 is orthogonal to the corresponding test line 5. The arithmetic average of lengths of the two test lines 5 and 6 is determined to be the crystal grain size of the corresponding crystal grain. The arithmetic average of crystal grain sizes of all (001) crystal grains 3 in an arbitrary measurement region is determined to be the average crystal grain size.

The (001) crystal grain area fraction is determined by the following method. A cross-section of a metal sheet (a cross-section along the sheet thickness direction) is observed using SEM, and an arbitrary measurement region including a region (a line-shaped region) corresponding to the surface of a metal sheet (a face that is opposite to the sheet thickness direction) is selected. (001) crystal grains 3 are selected by the EBSD method. The area fraction of (001) crystal grains 3 in a region corresponding to the surface of a metal sheet (a face opposite to the sheet thickness direction) in each field of view is calculated, thereby obtaining the area fraction of (001) crystal grains 3. The average of area fractions of (001) crystal grains 3 in an arbitrary measurement region is determined to be the area fraction of (001) crystal grains.

In a case in which a plated layer or the like is formed on the surface of a metal sheet, the area fraction of (001) crystal grains 3 is measured for a region (a line-shaped region) corresponding to the surface of a metal sheet which is in contact with the plated layer or the like.

[Crystal Grains Other than (111) Crystal Grains]

In a case in which molding that causes plane strain tensile deformation, or plane strain tensile deformation and biaxial tensile deformation is conducted, crystal grains (i.e., crystal grains having a crystal orientation of more than 15° relative to a (111) plane parallel to the surface of a metal sheet) other than crystal grains having a crystal orientation of 15° or less relative to a (111) plane parallel to a surface of a metal sheet ((111) crystal grains) satisfy either of the following (A) or (B) on the surface of a metal sheet:

(A) the area fraction of crystal grains other than (111) crystal grains is from 0.25 to 0.55; or (B) the area fraction of crystal grains other than (111) crystal grains is 0.55 or less, and the average crystal grain size thereof is 15 μm or less.

As stated above, in the case of a metal sheet having a bcc structure, crystal grains other than (111) crystal grains are susceptible to plane strain tensile deformation and non-equi-biaxial tensile deformation similar to plane strain deformation (meaning that (111) crystal grains are most resistant to the stress). Therefore, in a case in which, in addition to deep drawing molding or overhang molding, molding of a metal sheet such as bending molding that causes plane strain tensile deformation, or plane strain tensile deformation and biaxial tensile deformation is conducted at a large machining amount (a machining amount that results in a sheet thickness decrease rate of from 10% to 30% for at least a part of the metal sheet), strain is likely to be concentrated on crystal grains other than (111) crystal grains, which facilitates formation of protrusions and recesses on crystal grains other than (111) crystal grains. In addition, in a case in which the proportion of crystal grains other than (111) crystal grains is large, strain is likely to be concentrated, which facilitates formation of protrusions and recesses. Meanwhile, in a case in which the proportion of crystal grains other than (111) crystal grains is small, there are few portions on which strain is concentrated, and localized deformation occurs in a distributed manner also in (111) crystal grains, which, in turn, facilitates formation of protrusions and recesses. Note that, also in a case in which the proportion of crystal grains other than (111) crystal grains is small, when the size of crystal grains other than (111) crystal grains is sufficiently small, a region of localized deformation of (111) crystal grains also becomes small. This results in formation of fine protrusions and recesses, which is unlikely to be regarded as abnormal grain growth of a molded product.

Therefore, in a case in which a metal sheet satisfies (A) described above, adequate concentration of strain due to molding is achieved. Accordingly, formation of protrusions and recesses is inhibited, thereby inhibiting abnormal grain growth of a molded product. Meanwhile, in a case in which a metal sheet satisfies (B) described above, adequate concentration of strain due to molding is achieved with an area fraction of crystal grains other than (111) crystal grains within a range of from 0.25 to 0.55. In a case in which the area fraction of crystal grains other than (111) crystal grains is less than 0.25, formation of protrusions and recesses is unlikely to be regarded as abnormal grain growth of a molded product. Accordingly, abnormal grain growth of a molded product is inhibited.

In addition, the average crystal grain size of crystal grains other than (111) crystal grains is 15 μm or less on the condition (B). However, in view of inhibition of abnormal grain growth, it is preferably 10 μm or less. Although a smaller average crystal grain size of crystal grains other than (111) crystal grains is more preferable in terms of inhibition of abnormal grain growth, the average crystal grain size is preferably 1 μm or more. This is because since the orientation is controlled by recrystallization, it is difficult to achieve drastic reduction of the crystal grain size and orientation control in a well-balanced manner.

The average crystal grain size of crystal grains other than (111) crystal grains is measured as in the case of the average crystal grain size of (001) crystal grains except that crystal grains to be measured are different.

Meanwhile, the area fraction of crystal grains other than (111) crystal grains is determined as in the case of (001) crystal grains except that crystal grains to be measured are different.

[Chemical Composition]

A ferrite-based steel sheet that is appropriate as a metal sheet preferably has a chemical composition in which, for example, 0.0060% by mass or less of C, 1.0% by mass or less of Si, 1.50% by mass or less of Mn, 0.100% by mass or less of P, 0.010% by mass or less of S, 0.00050% to 0.10% by mass of Al, 0.0040% by mass or less of N, 0.0010% to 0.10% by mass of Ti, 0.0010% to 0.10% by mass of Nb, and 0% to 0.0030% by mass of B are contained, the balance consists of Fe and impurities, and the F1 value defined by Formula (1) below is from more than 0.7 to 1.2.

$$F1=(C/12+N/14+S/32)/(Ti/48+Nb/93) \quad \text{Formula (1):}$$

In Formula (1), the content (% by mass) of each element in steel is assigned into the corresponding element symbol.

The chemical composition of a ferrite-based steel sheet that is appropriate as a metal sheet is described below. The symbol "%" means a percent by mass in the chemical composition.

C: 0.0060% or less

Carbon (C) is regarded herein as an impurity. It is known that C causes reduction of ductibility and deep drawing moldability of a steel sheet in usual types of IF steel. In view of this, a smaller C content is more preferable. Therefore, the C content is desirably 0.0060% or less. The lower limit of C content can be set in consideration of refining cost, if appropriate. The lower limit of C content is, for example, 0.00050%. The upper limit of C content is preferably 0.0040% and more preferably 0.0030%.

Si: 1.0% or less

Silicon (Si) is regarded herein as an impurity. However, Si increases strength of a steel sheet through solid solution strengthening while inhibiting reduction of ductibility of a steel sheet. For such reason, Si may be contained, if necessary. The lower limit of Si content is, for example, 0.005%. In a case in which it is intended to strengthen hardness of a steel sheet, the lower limit of Si content is, for example, 0.10%. Meanwhile, in a case in which the Si content is excessively high, surface texture of a steel sheet deteriorates. Therefore, the Si content is desirably 1.0% or less. The upper limit of Si content is preferably 0.5%. In a case in which strength of a steel sheet is not required, the upper limit of Si content is more preferably 0.05%.

Mn: 1.50% or less

Manganese (Mn) is regarded herein as an impurity. However, Mn increases strength of a steel sheet through solid solution strengthening. Further, Mn immobilizes sulfur (S) in the form of MnS. Therefore, hot shortness of steel is inhibited as a result of FeS generation. Further, Mn causes reduction of the temperature of transformation from austenite to ferrite. Accordingly, formation of fine crystal grains of a hot-rolled steel sheet is promoted. For such reasons, Mn may be contained, if necessary. The lower limit of Mn content is, for example, 0.05%. Meanwhile, in a case in which the Mn content is excessively large, deep drawing moldability and ductibility of a steel sheet decline. Therefore, the Mn content is desirably 1.50% or less. The upper limit of Mn content is preferably 0.50% and more preferably 0.20%.

P: 0.100% or less

Phosphorus (P) is regarded herein as an impurity. However, P prevents the r value of a steel sheet from decreasing through solid solution strengthening and increases strength of a steel sheet. For such reason, P may be contained, if necessary. The lower limit of P content can be set in consideration of refining cost, if appropriate. The lower limit of P content is, for example, 0.0010%. Meanwhile, in a case in which the P content is excessively large, ductibility of a steel sheet declines. Therefore, the P content is preferably 0.100% or less. The upper limit of P content is preferably 0.060%.

S: 0.010% or less

Sulfur (S) is regarded herein as an impurity. Sulfur causes reduction of moldability and ductibility of a steel sheet. Therefore, the S content is preferably 0.010% or less. The lower limit of S content can be set in consideration of refining cost, if appropriate. The lower limit of S content is, for example, 0.00030%. The upper limit of S content is preferably 0.006% and more preferably 0.005%. It is preferable that the S content is minimized to a possible extent.

Al: 0.00050% to 0.10%

Aluminum (Al) deacidifies liquid steel. In order to achieve such effect, it is preferable to set the Al content to 0.00050% or less. However, when the Al content is excessively large, ductibility of a steel sheet declines. Therefore, the Al content is from 0.00050% to 0.10% in many cases. The upper limit of Al content is preferably 0.080% and more preferably 0.060%. The lower limit of Al content is preferably 0.005. The term "Al content" used herein refers to the content of so-called acid-soluble Al (sol. Al).

N: 0.0040% or less

Nitrogen (N) is regarded herein as an impurity. Nitrogen causes reduction of moldability and ductibility of a steel sheet. Therefore, the N content is preferably 0.0040% or less. The lower limit of N content can be set in consideration of refining cost, if appropriate. The lower limit of N content is, for example, 0.00030%.

Ti: 0.0010% to 0.10% Titanium (Ti) binds to C, N, and S, thereby forming carbide, nitride, and sulfide. In a case in which the Ti content is excess with respect to the C content, N content, and S content, a solid solution of C and a solid solution of N decline. In the case of ordinary IF steel, it is desirable that Ti is contained such that F1 defined in Formula (1) described below is adjusted to 0.7 or less. However, excess Ti, which does not bind to C, N, and S, remains in the form of solid solution in steel. An excessive increase of a solid solution of Ti causes an increase in the recrystallization temperature of steel, which makes it necessary to increase the annealing temperature. In this case, as stated below, formation of crystal grains (especially (001) crystal grains) other than (111) crystal grains is facilitated after annealing. Further, when a solid solution of Ti excessively increases, a steel material becomes hardened, which causes deterioration of workability. Accordingly, moldability of a steel sheet declines. Therefore, in order to decrease the recrystallization temperature of steel, the upper limit of Ti content is desirably 0.10%. The upper limit of Ti content is preferably 0.08% and more preferably 0.06%.

Meanwhile, as stated above, Ti forms a carbonitride, thereby improving moldability and ductibility. In order to obtain this effect, the upper limit of Ti content is desirably 0.0010%. The lower limit of Ti content is preferably 0.005% and more preferably 0.01%.

Nb: 0.0010% to 0.10%

Niobium (Nb) binds to C, N, and S, thereby forming carbide, nitride, and sulfide, as with Ti. In a case in which the Nb content is excess with respect to the C content, N content, and S content, a solid solution of C and a solid solution of N decline. However, excess Nb, which does not bind to C, N, and S, remains in the form of solid solution in steel. In a case in which a solid solution of Nb excessively increase, it is necessary to increase the annealing temperature. In this case, formation of crystal grains (especially (001) crystal grains) other than (111) crystal grains is facilitated after annealing. Therefore, in order to decrease the recrystallization temperature of steel, the upper limit of Nb content is desirably 0.10%. The upper limit of Nb content is preferably 0.050% and more preferably 0.030%.

Meanwhile, as stated above, Nb forms a carbonitride, thereby improving moldability and ductibility. Further, Nb inhibits recrystallization of austenite, thereby causing formation of fine crystal grains of a hot-rolled sheet. In order to obtain this effect, the lower limit of Nb content is desirably 0.0010%. The lower limit of Nb content is preferably 0.0012% and more preferably 0.0014%.

B: 0 to 0.0030%

Boron (B) is an optional element. Usually, a steel sheet of ultralow carbon, in which a solid solution of N or a solid solution of C has been reduced, has a low grain boundary strength. Therefore, in a case in which molding that causes plane strain deformation and biaxial tensile deformation, such as deep drawing molding or overhang molding, is conducted, protrusions and recesses are formed, which tends to cause the occurrence of abnormal grain growth of a molded product. B increases grain boundary strength, thereby improving resistance to abnormal grain growth. Therefore, B may be contained, if necessary. Meanwhile, when the B content exceeds 0.0030%, the r value decreases. Therefore, the upper limit of B content is preferably 0.0030% and more preferably 0.0010% in a case in which B is contained. In order to obtain an effect of increasing grain boundary strength with certainty, it is preferable to set the B content to 0.0003% or more.

Balance

The balance consists of Fe and impurities. An impurity described herein means a substance that is accidentally mixed in from an ore or scrap as a starting material or in a production environment, etc. upon industrial production of a steel material, which is acceptable unless it disadvantageously affects a steel sheet.

[Regarding Formula (1)]

In the above-described chemical composition, F1 defined in Formula (1) is from more than 0.7 to 1.2.

$$F1=(C/12+N/14+S/32)/(Ti/48+Nb/93) \quad \text{Formula (1):}$$

In Formula (1), the content (% by mass) of each element in steel is assigned into the corresponding element symbol.

F1 is a parameter formula indicating a relationship between C, N, and S which cause deterioration of moldability and Ti and Nb. A lower value of F1 means excessive Ti and Nb contents. In this case, as Ti and Nb tend to form carbonitride with C and N, a solid solution C of and a solid solution of N can be reduced. Accordingly, moldability is improved. Note that an excessively low value of F1, which is specifically F1 of 0.7 or less, means significantly excessive Ti and Nb contents. In this case, a solid solution of Ti and a solid solution of Nb increase. In a case in which a solid solution of Ti and a solid solution of Nb increase, the recrystallization temperature of steel increases. Therefore, it is necessary to increase the annealing temperature. In a case in which the annealing temperature is high, crystal grains (especially (001) crystal grains) other than (111) crystal grains tend to grow. In this case, protrusions and recesses are formed upon molding, which facilitates the occurrence of abnormal grain growth in a molded product. Therefore, the lower limit of F1 is more than 0.7.

Meanwhile, an excessively high F1 value causes a solid solution of C and a solid solution of N to increase. In this case, moldability of a steel sheet declines due to age hardening. Further, the recrystallization temperature of steel increases. Therefore, it is necessary to increase the annealing temperature. In a case in which the annealing temperature is high, crystal grains (especially (001) crystal grains) other than (111) crystal grains tend to grow. In this case, protrusions and recesses are formed upon molding, which facilitates the occurrence of abnormal grain growth in a molded product.

Therefore, the F1 value is from more than 0.7 to 1.2. The lower limit of F1 is 0.8 and more preferably 0.9. The upper limit of the F1 value is preferably 1.1.

[Method of Producing Metal Sheet]

One example of a method of producing a ferrite-based steel sheet that is preferable as a metal sheet is described below.

The above example of the method includes a surface strain generation step, a heating step, a hot rolling step, a cooling step, a winding step, a cold rolling step, and an annealing step. The drafts for the last two paths in the hot rolling step and the finishing temperature in hot rolling step are important for achieving a metallic structure of a ferrite-based steel sheet. A draft of 50% in total is achieved in the hot rolling step and the finishing temperature is set to $Ar_3$+30° C. or higher for a slab having the above-described chemical composition. Thus, a ferrite-based steel sheet can be obtained.

[Surface Strain Generation Step]

At first, a ferrite-based steel sheet is produced. For example, a slab having the above-described chemical composition is produced. In the surface strain generation step, strain is generated in the surface layer of a slab before the hot rolling step or during rough rolling. A method of generating strain involves, for example, shot peening processing, cutting processing, or differential speed rolling during rough rolling. Strain generation before hot rolling causes the average crystal grain size of crystal grains in the surface layer of a steel sheet after hot rolling to decrease. Further, upon recrystallization of crystal grains, (111) crystal grains are preferentially formed. Accordingly, formation of crystal grains (especially (001) crystal grains) other than (111) crystal grains can be inhibited. In the surface strain generation step, it is preferable to set the amount of equivalent plastic strain of the surface to 25% or more and more preferably 30% or more.

[Heating Step]

The above-described slab is heated in the heating step. For heating, it is preferable to set the finishing temperature for finishing rolling in the hot rolling step (surface temperature of a hot-rolled steel sheet after the last stand) within a range of $Ar_3$+30° C. to 50° C., if appropriate. In a case in which the heating temperature is 1000° C. or more, the finishing temperature tends to be $Ar_3$+30° C. to 50° C. It is therefore preferable that the lower limit of heating temperature is 1000° C. In a case in which the heating temperature exceeds 1280° C., it results in scale formation in a large amount, which causes the yield to decrease. It is therefore preferable that the upper limit of heating temperature is 1280° C. In a case in which the heating temperature is within the above-described, ductibility and moldability of a steel sheet are improved at a lower heating temperature. It is therefore more preferable that the upper limit of heating temperature is 1200° C.

[Hot Rolling Step]

The hot rolling step involves rough rolling and finishing rolling. Rough rolling is to roll a slab to result in a certain thickness, thereby producing a hot-rolled steel sheet. Scale formed on the surface may be removed during rough rolling. In a case in which the surface strain generation step is not conducted before the hot rolling step, the surface strain generation step is conducted during rough rolling, thereby generating strain on the surface layer of a slab.

The temperature during hot rolling is maintained such that steel is within the austenite range. Distortion is accumulated in austenite crystal grains by hot rolling. The steel structure is transformed from austenite to ferrite by cooling after hot rolling. The release of distortion accumulated in austenite crystal grains is inhibited during hot rolling because the temperature is within the austenite range. Cooling after hot rolling causes austenite crystal grains in which distortion has been accumulated to be transformed to ferrite at once, which is driven by accumulated distortion, when the temperature reaches a given temperature range. This allows formation of fine crystal grains in an efficient way. In a case in which the finishing temperature after hot rolling is $Ar_3$+30° C. or more, transformation from austenite to ferrite can be inhibited during rolling. Therefore, the lower limit of finishing temperature is $Ar_3$+30° C. In a case in which the finishing temperature is $Ar_3$+100° C. or more, distortion accumulated in austenite crystal grains is readily released by hot rolling. This makes it impossible to form fine crystal grains in an efficient way. It is therefore preferable that the upper limit of finishing temperature is $Ar_3$+100° C. In a case in which the finishing temperature is $Ar_3$+50° C. or less, strain can be stably accumulated in austenite crystal grains. Therefore, fine crystal grains (especially (001) crystal grains) other than (111) crystal grains can be formed. Further, upon recrystallization of crystal grains, (111) crystal grains are preferentially formed from the crystal grain boundary. Accordingly, crystal grains (especially (001) crystal grains) other than (111) crystal grains can be reduced. In this case, formation of protrusions and recesses is inhibited upon molding, which facilitates inhibition of abnormal grain growth of a molded product. Therefore, the upper limit of finishing temperature is preferably $Ar_3$+50° C.

Finishing rolling is to further roll a hot-rolled steel sheet that has a certain thickness as a result of rough rolling. Upon finishing rolling, continuous rolling is conducted by a plurality of paths using a plurality of stands aligned in series. A greater draft per path means a larger amount of strain accumulated in austenite crystal grains. In particular, the draft for the last two paths (i.e., the draft for the last stand and the stand second to the last) is set to 50% or more by adding up sheet thickness decrease rates. In this case, fine crystal grains of a hot-rolled steel sheet can be formed.

[Cooling Step]

After hot rolling, a hot-rolled steel sheet is cooled. Cooling conditions can be set, if appropriate. The maximum rate of cooling until termination of cooling is preferably 100° C./s or more. In this case, strain accumulated in austenite crystal grains as a result of hot rolling is released, which facilitates formation of fine crystal grains. A more rapid cooling rate is more preferable. The time period from the completion of rolling to cooling to 680° C. is preferably from 0.2 to 6.0 seconds. In a case in which the time period from the completion of rolling to cooling to 680° C. is 6.0 seconds or less, fine crystal grains can be easily formed after hot rolling. In a case in which the time period from the completion of rolling to cooling to 680° C. is 2.0 seconds or less, further fine crystal grains can be easily formed after hot rolling. In addition, upon recrystallization of crystal grains, (111) crystal grains are preferentially formed from the crystal grain boundary. Accordingly, crystal grains (especially (001) crystal grains) other than (111) crystal grains are likely to be reduced.

[Winding Step]

It is preferable to conduct the winding step at from 400° C. to 690° C. In a case in which the winding temperature is 400° C. or more, it is possible to prevent a solid solution of C or a solid solution of N from remaining due to insufficient carbonitride precipitation. In this case, moldability of a cold-rolled steel sheet is improved. In a case in which the winding temperature is 690° C. or less, it is possible to inhibit formation of coarse crystal grains during slow cooling after winding. In this case, moldability of a cold-rolled steel sheet is improved.

[Cold Rolling Step]

After the winding step, a hot-rolled steel sheet is treated by cold rolling, thereby producing a cold-rolled steel sheet. A greater draft in the cold rolling step is preferable. In a case in which a ferrite-based thin steel sheet is an ultralow carbon steel, when a draft increases to a certain level, it facilitates formation of (111) crystal grains. This tends to cause an increase in the r value after annealing. Therefore, the draft in the cold rolling step is preferably 40% or more, more preferably 50% or more, and still more preferably 60% or more. The practical upper limit of the draft in the cold rolling step is 95% in consideration of the use of an annealed steel sheet in a rolling facility.

[Annealing Step]

The annealing step is conducted for a cold-rolled steel sheet after the cold rolling step. The annealing method may involve either continuous annealing or box annealing. The annealing temperature is preferably higher than the recrystallization temperature. In this case, recrystallization is promoted, and ductibility and moldability of a cold-rolled steel sheet are improved. Meanwhile, the annealing temperature is preferably 830° C. or less. In a case in which the annealing temperature is 830° C. or less, it is possible to inhibit formation of coarse crystal grains. In this case, formation of protrusions and recesses is inhibited upon molding, which facilitates inhibition of abnormal grain growth of a molded product.

Note that a conventionally used index of press moldability is the r value. Usually, the r value increases when there are many (111) crystal grains but few (001) crystal grains on the surface of a steel sheet having a bcc structure. A higher r value is considered to mean a higher level of moldability. In addition, the optimum annealing temperature for achieving a high r value has been selected.

However, the r value cannot be used as an index for inhibition of abnormal grain growth. This is because no matter how high or low the r value is, abnormal grain growth tends to occur. In addition, there is no correlation between plots of the r value and plots of the incidence of abnormal grain growth. Here, crystal grains (especially (001) crystal grains) other than (111) crystal grains on the surface of a steel sheet are used as an index of abnormal grain growth inhibit, instead of the r value.

It is desirable to control the area fraction of crystal grains (especially (001) crystal grains) other than (111) crystal grains on a surface of a steel sheet based on a combination of the annealing temperature and conditions for processing heat treatment prior to annealing (e.g., the machining amount, hot-rolled temperature, and cold rolling rate before hot rolling). Specifically, it is desirable to select soaking temperature conditions of from 750° C. to 830° C. in the annealing step.

It is preferable that the annealing temperature for a ferrite-based steel sheet is lower than annealing temperatures in the prior art. This is because it is easier to inhibit formation of coarse crystal grains at a lower annealing temperature. In order to set the annealing temperature to a low level, it is necessary to set the recrystallization temperature of a cold-rolled steel sheet to a low level. It is therefore preferable to set the C, Ti and Nb contents in the chemical composition of a ferrite-based thin steel sheet to levels lower than those in the prior art. Thus, recrystallization can be promoted even at an annealing temperature of 830° C. or less.

A ferrite-based steel sheet, which is a preferable metal sheet, can be produced by the above steps. In a case in which there are few crystal grains (especially (001) crystal grains) other than (111) crystal grains, the draft is largely increased, thereby causing shear bands in a steel sheet to increase. Accordingly, crystal grains (especially (001) crystal grains) other than (111) crystal grains can be increased after annealing.

(Molded Product)

The first molded product of the disclosure is a molded product of a metal sheet including a bcc structure, in which a shape of the molded product results from plane strain tensile deformation and biaxial tensile deformation. In addition, for the first molded product of the disclosure, given that the maximum sheet thickness and the minimum sheet thickness of the molded product are represented by D1 and D2, respectively, a formula $10 \leq (D1-D2)/D1 \times 100 \leq 3$ is satisfied. Or given that the maximum hardness and the minimum hardness of the molded product are represented by H1 and H2, respectively, a formula $15 \leq (H1-H2)/H1 \times 100 \leq 40$ is satisfied. In addition, either of the following conditions (c) or (d) is satisfied on a surface of the molded product:

(c) the area fraction of crystal grains ((001) crystal grains) having a crystal orientation of 15° or less relative to a (001) plane parallel to a surface of the molded product is from 0.20 to 0.35;

(d) the area fraction of crystal grains ((001) crystal grains) having a crystal orientation of 15° or less relative to a (001) plane parallel to a surface of the molded product is 0.45 or less, and the average crystal grain size thereof is 15 μm or less.

The second molded product of the disclosure is a molded product of a metal sheet including a bcc structure, in which a shape of the molded product results from plane strain tensile deformation, or plane strain tensile deformation and biaxial tensile deformation. In addition, for the second molded product of the disclosure, given that the maximum sheet thickness and the minimum sheet thickness of the molded product are represented by D1 and D2, respectively, an inequality formula $10 \leq (D1-D2)/D1 \times 100 \leq 30$ is satisfied. Or given that the maximum hardness and the minimum hardness of the molded product are represented by H1 and H2, respectively, an inequality formula $15 \leq (H1-H2)/H1 \times 100 \leq 40$ is satisfied. In addition, either of the following conditions (C) or (D) is satisfied on the surface of the molded product:

(C) the area fraction of crystal grains other than crystal grains ((111) crystal grains) having a crystal orientation of 15° or less relative to a (111) plane parallel to a surface of the molded product is from 0.25 to 0.55;

(D) the area fraction of crystal grains other than crystal grains ((111) crystal grains) having a crystal orientation of 15° or less relative to a (111) plane parallel to a surface of the molded product is 0.55 or less, and the average crystal grain size thereof is 15 μm or less.

The term "metal sheet having a bcc structure" used herein has the same meaning as a "metal sheet" used in a method of producing the first and second molded products of the disclosure.

A molded product of the metal sheet is treated by molding that causes plane strain tensile deformation, or plane strain tensile deformation and biaxial tensile deformation. Whether a molded product is treated by molding that causes plane strain tensile deformation, or plane strain tensile deformation and biaxial tensile deformation is confirmed in the following manner.

The three-dimensional shape of a molded product is measured, and mesh generation for numerical analysis is conducted. The process of forming a sheet material into a three-dimensional shape is developed by back analysis using a computer. Then, the ratio between the maximum main strain and the minimum main strain for each mesh (β described above) is calculated. Whether a molded product is treated by molding that causes plane strain tensile deformation, or plane strain tensile deformation and biaxial tensile deformation can be confirmed based on the calculation.

For example, a three-dimensional shape of a molded product is measured by a three-dimensional measuring instrument Comet L3D (Tokyo Boeki Techno-System Ltd.) or the like. Mesh shape data of a molded product are obtained based on the obtained measurement data. Next, the obtained mesh shape data are used for developing the mesh shape on a flat sheet based on the original molded product shape by numerical analysis in accordance with the one-step method (using a work hardening calculation tool "HYCRASH (JSOL Corporation)" or the like). A change in the sheet thickness, the residual strain, and other factors are calculated for a molded product based on the shape information of the analysis including the extension and bending status of a molded product. Whether a molded product is treated by molding that causes plane strain tensile deformation, or plane strain tensile deformation and biaxial tensile deformation can also be confirmed based on the above calculation.

In addition, in a case in which a formula $10 \leq (D1-D2)/D1 \times 100 \leq 30$ is satisfied, it can be regarded that a molded product has been formed by molding that allows at least a part of a metal sheet to have a sheet thickness decrease rate of from 10% to 30%.

In other words, the maximum sheet thickness D1 of a molded product can be regarded as the sheet thickness of a metal sheet before molding, and the minimum sheet thickness D2 of a molded product can be regarded as the sheet thickness of a portion of a metal sheet (molded product) having the largest sheet thickness decrease rate after molding.

Meanwhile, also in a case in which a formula $15 \leq (H1-H2)/H1 \times 100 \leq 40$ is satisfied, it can be regarded that a molded product has been formed by molding that allows at least a part of a metal sheet to have a sheet thickness decrease rate of from 10% to 30%. This is based on the fact that as the machining amount (sheet thickness decrease rate: thickness reduction) upon molding increases, the degree of work hardening (i.e., work hardness: Vickers hardness) increases (see FIG. 11).

In other words, a portion of a molded product having the maximum hardness H1 can be regarded as the hardness of a portion of a metal sheet (molded product) having the largest sheet thickness decrease rate after molding, and the minimum hardness H2 of a molded product can be regarded as the hardness of a metal sheet before molding.

Here, hardness is measured by the Vickers hardness measurement method specified in the Japanese Industrial Standards (JIS) (JISZ2244). Note that measurement of hardness is not limited to this method, and it is also possible to employ a method in which hardness is measured in a different manner and the hardness is converted to Vickers hardness based on the hardness conversion table.

In addition, under the above-described condition (c) or (d) and condition (C) or (D), the area fraction and average crystal grain size of (001) crystal grains on a surface of a molded product and the area fraction and average crystal grain size of crystal grains other than (111) crystal grains on a surface of a molded product are measured for a portion of a molded product, which has the maximum sheet thickness D1 or the minimum hardness H2.

The condition (c) or (d) has the same meaning as the above-described condition (a) or (b) for the first method of producing a molded product of the disclosure except that the area fraction and average crystal grain size of (001) crystal grains on a surface of a molded product, instead of a metal sheet, before molding are employed.

Similarly, the condition (C) or (D) has the same meaning as the above-described condition (A) or (B) for the second method of producing a molded product of the disclosure except that the area fraction and average crystal grain size of crystal grains other than (111) crystal grains on a surface of a molded product, instead of a metal sheet, before molding are employed.

As explained above, the first and second molded products of the disclosure can be regarded as molded products formed by the first and second methods of producing a molded product of the disclosure as long as they satisfy each of the above-described requirements. In addition, each of the first and second molded products of the disclosure is a molded product that is excellent in design because of prevention of the occurrence of abnormal grain growth, even when the molded product is a molded product of metal sheet including a bcc structure, in which a shape of the molded product results from plane strain tensile deformation, or plane strain tensile deformation and biaxial tensile deformation, and either of the following conditions are satisfied: Formula: $10 \leq (D1-D2)/D1 \times 100 \leq 30$; or Formula: $10 \leq (H1-H2)/H1 \times 100 \leq 30$.

EXAMPLES

First Example

[Forming of Molded Product]

Steel pieces each having either one of the chemical compositions listed in Table 1 were processed under the corresponding conditions listed in Table 2, thereby obtaining steel sheets. Specifically, at first, steel pieces of steel types A and B listed in Table 1 were treated under the corresponding conditions listed in Table 2 in a surface strain generation step, a heating step, a hot rolling step, and a cooling step. An experimental roller was used for processing. Next, each cold-rolled steel sheet cooled to the winding temperature was introduced into an electric furnace maintained at a temperature corresponding to the winding temperature. The temperature was maintained for 30 minutes and cooling was conducted at a rate of 20° C./h, followed by simulation of a winding step. Further, a cold rolling step was conducted at the corresponding draft listed in Table 2, thereby obtaining a cold-rolled steel sheet having the corresponding sheet thickness in Table 2. The thus obtained each cold-rolled steel sheet was annealed at the corresponding temperature. Accordingly, steel sheets 1 to 8 were obtained. The ferrite fractions of steel sheets 1 to 8 were 100%.

Subsequently, the obtained steel sheets were treated by overhang processing, thereby forming dish-shaped molded products No. 1 to 5 and 8, each of which was obtained as a molded product 20 having a diameter R of a top panel 20A of 150 mm, a height H of 18 mm, and an angle θ of a longitudinal wall 20B of 90° C. as illustrated in FIG. 12. In addition, molded products No. 6 to 7 and 9 were formed as with molded products No. 1 to 5 and 8 except that the height H of molded product 20 was changed to 15 mm.

This molding was conducted at a machining amount that allowed the sheet thickness decrease rate of a steel sheet serving as a top panel 20A (i.e., the sheet thickness decrease rate of an evaluation portion A of top panel 20A (the center portion of a top panel 20A) in FIG. 12) to be equivalent to the corresponding sheet thickness decrease rate listed in Table 3.

[Evaluation Method]

The following measurement test and visual observation evaluation were conducted for the obtained steel sheets and molded products. Tables 3 and 4 show the results. FIG. 17 illustrates visual observation evaluation results and the relationship between the average crystal grain size and crystal grain sizes of (001) crystal grains for the molded products obtained in the Examples.

[Average Crystal Grain Size Measurement Test]

A test of measuring the average crystal grain size of (001) crystal grains was conducted for the steel sheets. The EBSD method was used for the measurement test. FIG. 13 schematically illustrates an observational view of a steel sheet from the top. A 1 mm square measurement region 4 was arbitrarily selected at three sites in a center area excluding a one-fourth width area from each edge in the steel sheet width direction with reference to FIG. 13. In each measurement region 4, crystal grains having a crystal orientation of 15° or less relative to a (001) plane parallel to the steel sheet surface ((001) crystal grains 3) on the surface of a steel sheet were selected.

The average crystal grain size of (001) crystal grains 3 was calculated in the above-described manner. Measurement was conducted using all (001) crystal grains 3 in measurement regions 4 at the three sites. The arithmetic average of crystal grain sizes of the obtained (001) crystal grains 3 was determined to be the average crystal grain size. Here, the average crystal grain size of (001) crystal grains 3 on the surface of a molded product is similar to the average crystal grain size of (001) crystal grains 3 of a steel sheet.

[Area Fraction Measurement Test]

A test of measuring the area fraction of (001) crystal grains was conducted for each steel sheet. Measurement regions 4 were selected for each steel sheet, and (001) crystal grains 3 were selected using the EBSD method as described above. The area fraction of (001) crystal grains 3 was calculated for each field of view, and the average value thereof was determined. Here, the area fraction of (001) crystal grains 3 of a molded product is similar to the area fraction of (001) crystal grains 3 of a steel sheet.

[Average r Value Measurement Test]

An average r value measurement test was conducted for each steel sheet. Specifically, sheet-shaped No. 5 test pieces were collected along directions forming angles of 0°, 45°, and 90° with the rolling direction of each steel sheet (JISZ2241 (2011)). 10% strain was generated in each collected test piece. The r value (Lankford value) was calculated for each test piece based on the test piece width and the sheet thickness before and after strain generation. The arithmetic average of r values obtained in three directions of the test piece was determined to be the average r value.

[Sheet Thickness Measurement Test]

A sheet thickness measurement test was conducted for each molded product. Specifically, molding simulation of each molded product was conducted using a computer, thereby identifying a portion having the maximum sheet thickness and a portion having the minimum sheet thickness. Subsequently, sheet thickness measurement was conducted for each molded product at a portion having the maximum sheet thickness and a portion having the minimum sheet thickness using a sheet thickness gauge. Thus, the maximum sheet thickness D1 and the minimum sheet thickness D2 were obtained. Note that the maximum sheet thickness of a molded product (the entire molded product) was obtained as the maximum sheet thickness D1, and the minimum sheet thickness of an evaluation portion of a molded product was obtained as the minimum sheet thickness D2.

[Hardness Measurement Test]

A hardness measurement test was conducted for each molded product. Specifically, molding simulation of each molded product was conducted using a computer, thereby identifying a portion having the maximum equivalent plastic strain and a portion having the minimum equivalent plastic strain. Subsequently, hardness measurement was conducted for each molded product at a portion having the maximum sheet thickness and a portion having the minimum sheet thickness in accordance with JIS (JISZ2244). Thus, the maximum hardness H1 and the minimum hardness H2 were obtained. Note that the maximum hardness of a molded product (the entire molded product) was obtained as the maximum hardness H1, and the minimum hardness of an evaluation portion of a molded product was obtained as the minimum hardness H2.

[Protrusion Height and Recess Depth Measurement Test]

A protrusion height and recess depth measurement test was conducted for each molded product. Specifically, an evaluation of each molded product was excised, and protrusions and recesses formed in the longitudinal direction were measured using a contact-type profilometer. In order to confirm the crystal orientation, a portion including the most visible protrusions and recesses was cut by processing using a CROSS SECTION POLISHER, and the relationship between the crystal orientation and protrusions and recesses of the surface layer was analyzed.

[Visual Observation Evaluation]

Originally, electrodeposition coating is conducted after chemical conversion treatment. However, as a simplified evaluation technique, a lacquer spray was uniformly applied to the surface of a molded product, followed by visual observation. Then, the incidence of abnormal grain growth and the degree of sharpness of an evaluation face were examined in accordance with the following criteria.

Further, as another parameter indicating the degree of excellence of surface texture, arithmetic average value of wave Wa was determined using laser microscope manufactured by Keyence Corporation. Measurement conditions were an evaluation length of 1.25 mm and a cutoff wavelength λc of 0.25 mm. Then, profiles on the long wavelength side of the cutoff wavelength λc were evaluated.

Evaluation criteria are as follows.

A: No pattern is confirmed by visual observation on the surface of an evaluation portion of the top panel of a molded product, and the surface is shiny (Wa≤0.5 μm). The molded product is more desirable as an automobile exterior sheet part and can also be used as an exterior part of a luxury car.

B: Although no pattern is confirmed by visual observation on the surface of an evaluation portion of the top panel of a molded product, the shiny appearance of the surface is lost (0.5 μm≤Wa≤1.0 μm). The molded product can be used as an automobile part.

C: Although a pattern is confirmed by visual observation on the surface of an evaluation portion of the top panel of a molded product, the surface is shiny (1.0 μm<Wa≤1.5 μm). The molded product cannot be used as an automobile exterior sheet part.

D: A pattern is confirmed by visual observation on the surface of an evaluation portion of the top panel of a molded product, and the surface is not shiny (1.5 μm<Wa). The molded product cannot be used as an automobile part.

TABLE 1

| Steel | Chemical composition (unit: % by mass; balance consisting of Fe and impurities) | | | | | | | | | | F1 | $A_{r3}$ point |
|---|---|---|---|---|---|---|---|---|---|---|---|---|
| type | C | Si | Mn | P | S | Al | N | Ti | Nb | B | value | (° C.) |
| A | 0.0029 | 0.012 | 0.09 | 0.020 | 0.003 | 0.041 | 0.003 | 0.013 | 0.023 | 0.0007 | 1.07 | 900 |
| B | 0.038 | 0.012 | 0.19 | 0.020 | 0.003 | 0.041 | 0.003 | 0.001 | 0.001 | 0.0001 | 110 | 850 |

TABLE 2

| | | Surface strain generation step Equivalent plastic strain surface layer (Strain generation by surfaces layer cutting before hot processing) | Processing step Processing temperature (° C.) | Hot rolling step Total draft for the last two paths | Hot rolling step Finishing temperature (° C.) | Cooling step Maximum cooling rate (° C./s) | Cooling step Time period from completion of rolling to cooling to 680° C. (s) | Winding step Winding temperature (° C.) | Cold rolling step Draft | Cold rolling step Cold-rolled steel sheet thickness | Annealing step Annealing temperature (° C.) |
|---|---|---|---|---|---|---|---|---|---|---|---|
| Steel sheet | Steel type | | | | | | | | | | |
| 1 | B | 30% | 1100 | 50% | 750 | 150 | 5.0 | 630 | 70% | 1.2 | 750 |
| 2 | A | 30% | 1100 | 50% | 750 | 200 | 3.0 | 680 | 70% | 0.75 | 800 |
| 3 | A | 30% | 1100 | 50% | 750 | 150 | 4.0 | 660 | 85% | 0.75 | 790 |
| 4 | A | 30% | 1100 | 50% | 750 | 130 | 5.0 | 670 | 75% | 1.2 | 825 |
| 5 | A | 30% | 1100 | 50% | 750 | 150 | 4.0 | 640 | 85% | 0.75 | 790 |
| 6 | A | 30% | 1100 | 50% | 750 | 150 | 4.0 | 660 | 75% | 0.75 | 830 |
| 7 | A | 30% | 1100 | 50% | 750 | 150 | 4.0 | 640 | 70% | 0.75 | 860 |
| 8 | A | 30% | 1100 | 50% | 750 | 150 | 2.0 | 650 | 75% | 0.75 | 820 |

TABLE 3

| | Molding conditions | | Steel sheet | | | | |
|---|---|---|---|---|---|---|---|
| | | Evaluation portion | | | | | |
| Molded product No. | Steel sheet | sheet thickness decrease rate [%] | Initial sheet thickness [mm] | {001} crystal grain average crystal grain size [μm] | {001} crystal grain area fraction | Average r value | Remarks |
| 1 | 1 | 25 | 1.2 | 20 | 0.38 | 1.1 | Comparative Example |
| 2 | 2 | 25 | 0.75 | 14 | 0.19 | 1.9 | Example |
| 3 | 3 | 25 | 0.75 | 10 | 0.30 | 1.7 | Example |
| 4 | 4 | 25 | 1.2 | 23 | 0.20 | 1.8 | Example |
| 5 | 5 | 25 | 0.75 | 15 | 0.35 | 1.5 | Example |
| 6 | 1 | 10 | 1.2 | 20 | 0.38 | 1.1 | Comparative Example |
| 7 | 3 | 10 | 0.75 | 10 | 0.19 | 1.9 | Example |
| 8 | 6 | 25 | 0.75 | 18 | 0.24 | 1.8 | Example |

TABLE 3-continued

| | Molding conditions | | | | | | |
|---|---|---|---|---|---|---|---|
| | | Evaluation portion | Steel sheet | | | | |
| Molded product No. | Steel sheet | sheet thickness decrease rate [%] | Initial sheet thickness [mm] | {001} crystal grain average crystal grain size [μm] | {001} crystal grain area fraction | Average r value | Remarks |
| 9 | 7 | 10 | 0.75 | 27 | 0.11 | 2.1 | Comparative Example |
| 10 | 8 | 25 | 0.75 | 14 | 0.45 | 2.0 | Example |

TABLE 4

| | Molded product | | | | | | | | | |
|---|---|---|---|---|---|---|---|---|---|---|
| Molded product No. | Maximum sheet thickness D1 [mm] | Minimum sheet thickness D2 [mm] | (D1 − D2)/D1 × 100 value | Maximum hardness H1 [mm] | Minimum hardness H2 [mm] | (H1 − H2)/H1 × 100 value | Recess depth/Protrusion height [μm] | $W_a$ [μm] | Visual observation evaluation | Remarks |
| 1 | 1.2 | 0.90 | 25 | 150 | 100 | 33 | 3.4 | 1.6 | D | Comparative Example |
| 2 | 0.75 | 0.56 | 25 | 154 | 106 | 31 | 1.2 | 0.6 | B | Example |
| 3 | 0.75 | 0.56 | 25 | 163 | 109 | 33 | 1.4 | 0.4 | A | Example |
| 4 | 1.2 | 0.9 | 25 | 148 | 97 | 34 | 2.8 | 1.1 | C | Example |
| 5 | 1.6 | 1.2 | 25 | 150 | 105 | 30 | 1.8 | 0.4 | A | Example |
| 6 | 1.2 | 1.08 | 10 | 122 | 100 | 18 | 1.2 | 1.6 | D | Comparative Example |
| 7 | 0.75 | 0.68 | 10 | 133 | 109 | 24 | 1.2 | 0.3 | A | Example |
| 8 | 0.75 | 0.56 | 25 | 163 | 110 | 32 | 1.4 | 0.7 | B | Example |
| 9 | 0.75 | 0.68 | 10 | 124 | 102 | 18 | 2.5 | 1.6 | D | Comparative Example |
| 10 | 0.75 | 0.56 | 25 | 165 | 111 | 33 | 1.8 | 0.4 | A | Example |

Based on the above results, it is understood that molded products No. 2 to 5, 7, 8, and 10 of the corresponding Examples are excellent in design because of inhibition of abnormal grain growth, compared with molded products No. 1, 6, and 9 of the corresponding Comparative Examples.

Here, FIGS. 14 to 16 each schematically illustrate cross-sectional micro-texture and surface protrusions and recesses for molded products No. 2 and 3 of the corresponding Examples and a molded product No. 1 of the corresponding Comparative Example. FIGS. 14 to 16 each schematically illustrate a cross-section of a molded product analyzed by the EBSD method. Note that ND represents a sheet thickness direction, and TD represents a sheet width direction in FIGS. 14 to 16.

A comparison of FIGS. 14 to 16 reveals that molded products No. 2 and 3 of the corresponding Examples are excellent in design because heights of protrusions and depths of recesses on the surface of a molded product are small, and therefore, abnormal grain growth is inhibited, compared with a molded product No. 1 of the corresponding Comparative Example. Note that a comparison of FIGS. 14 and 15 shows that a molded product No. 3 is excellent in design because although heights of protrusions and depths of recesses on the surface of a molded product are larger than those of a molded product No. 2, abnormal grain growth is inhibited. This is because even when heights of protrusions and depths of recesses on the surface of a molded product are larger than or equivalent to those of a molded product No. 2, if recesses are deep and fine, it may be unlikely to be regarded as abnormal grain growth (see also a comparison of a molded product No. 6 and a molded product No. 7).

A comparison of a molded product No. 7 of the corresponding Example and a molded product No. 9 of the corresponding Comparative Example reveals that even when the area fraction of (001) crystal grains is as low as less than 0.20, if the average crystal grain size of (001) crystal grains is less than 15 μm, abnormal grain growth is inhibited, resulting in excellent design.

A molded product No. 10 of the corresponding Example shows that even when the area fraction of (001) crystal grains is as high as 0.45, when the average crystal grain size of (001) crystal grains is less than 15 μm, abnormal grain growth is inhibited, resulting in excellent design.

Second Example

[Forming of Molded Product]

Next, steel sheets listed in Table 5 were treated by overhang processing, thereby forming dish-shaped molded products No. 101 to 105 and 108, each of which was obtained as a molded product 20 having a diameter R of a top panel 20A of 150 mm, a height H of 18 mm, and an angle θ of a longitudinal wall 20B of 90° C. as illustrated in FIG. 12. In addition, molded products No. 106 to 107, 109, and 128 were formed as with molded products No. 101 to 105 and 108 except that the height H of a molded product 20 was changed to 15 mm.

This molding was conducted at a machining amount that allowed the sheet thickness decrease rate of a steel sheet serving as a top panel 20A (i.e., the sheet thickness decrease rate of an evaluation portion A of top panel 20A (the center portion of top panel 20A) in FIG. 12) to be equivalent to the corresponding sheet thickness decrease rate listed in Table 5.

Further, molded products No. 110 to 118 and 129 were formed as with molded products No. 101 to 109 and 128 except that the height H of a molded product 20 was adjusted such that the sheet thickness decrease rate of an evaluation portion B of the top panel sheet 20A of a molded product 20 (the center portion between the center and an edge of a top panel 20A) in FIG. 12 was comparable to the sheet thickness decrease rate (the sheet thickness decrease rate of an evaluation portion A of a top panel sheet 20A in FIG. 12) of each of molded products No. 101 to 109 and 128.

Further, molded products No. 119 to 127 and 130 were formed as with molded products No. 101 to 109 and 128 except that the height H of a molded product 20 was adjusted such that the sheet thickness decrease rate of an evaluation portion C of the top panel sheet 20A of a molded product 20 (an edge portion of a top panel 20A) in FIG. 12 was comparable to the sheet thickness decrease rate (the sheet thickness decrease rate of an evaluation portion A of a top panel sheet 20A in FIG. 12) of each of molded products No. 101 to 109 and 128.

Upon molding for the above-described molded product, scribed circles were transferred to the surface of a steel sheet corresponding to an evaluation portion of a molded product, and changes in the shapes of the scribed circles were determined before and after molding (before and after deformation), thereby measuring the maximum main strain and the minimum main strain. A deformation ratio β for the evaluation portion of a molded produce was calculated based on the obtained values.

[Evaluation Method]

Each steel sheet used herein and each obtained molded product were examined by the following measurement tests and evaluation in accordance with the first Example: 1) average crystal grain size and area fraction of crystal grains other than (111) crystal grains; 2) average r value; 3) sheet thickness; 4) hardness; 5) protrusion height and recess depth; and 6) visual observation evaluation. Tables 5 and 6 list the results.

TABLE 5

| | Molding conditions | | | Steel sheet | | | | |
|---|---|---|---|---|---|---|---|---|
| Molded product No. | Steel sheet | Evaluation portion sheet thickness decrease rate [%] | Deformation ratioβ | Initial sheet thickness sheet thickness [mm] | Average crystal grain size of crystal grains other than (111) crystal grains [μm] | Area fraction of crystal grains other than (111) crystal grains | Average r value | Remarks |
| 101 | 1 | 25 | 0.96 | 1.2 | 20 | 0.62 | 1.1 | Comparative Example |
| 102 | 2 | 25 | 1.00 | 0.75 | 14 | 0.24 | 1.9 | Example |
| 103 | 3 | 25 | 0.96 | 0.75 | 10 | 0.30 | 1.7 | Example |
| 104 | 4 | 25 | 0.93 | 1.2 | 23 | 0.39 | 1.8 | Example |
| 105 | 5 | 25 | 0.97 | 0.75 | 15 | 0.25 | 1.5 | Example |
| 106 | 1 | 10 | 0.93 | 1.2 | 20 | 0.62 | 1.1 | Comparative Example |
| 107 | 3 | 10 | 0.97 | 0.75 | 10 | 0.28 | 1.9 | Example |
| 108 | 6 | 25 | 0.98 | 0.75 | 18 | 0.34 | 1.8 | Example |
| 109 | 7 | 10 | 0.98 | 0.75 | 27 | 0.18 | 2.1 | Comparative Example |
| 110 | 1 | 25 | 0.64 | 1.2 | 20 | 0.64 | 1.1 | Comparative Example |
| 111 | 2 | 25 | 0.60 | 0.75 | 14 | 0.24 | 1.9 | Example |
| 112 | 3 | 25 | 0.44 | 0.75 | 10 | 0.32 | 1.7 | Example |
| 113 | 4 | 25 | 0.27 | 1.2 | 23 | 0.45 | 1.8 | Example |
| 114 | 5 | 25 | 0.51 | 0.75 | 15 | 0.28 | 1.5 | Example |
| 115 | 1 | 10 | 0.45 | 1.2 | 20 | 0.63 | 1.1 | Comparative Example |
| 116 | 3 | 10 | 0.44 | 0.75 | 10 | 0.30 | 1.9 | Example |
| 117 | 6 | 25 | 0.58 | 0.75 | 18 | 0.38 | 1.8 | Example |
| 118 | 7 | 10 | 0.50 | 0.75 | 27 | 0.19 | 2.1 | Comparative Example |
| 119 | 1 | 25 | 0.03 | 1.2 | 20 | 0.68 | 1.1 | Comparative Example |
| 120 | 2 | 25 | 0.04 | 0.75 | 14 | 0.24 | 1.9 | Example |
| 121 | 3 | 25 | 0.05 | 0.75 | 10 | 0.32 | 1.7 | Example |
| 122 | 4 | 25 | 0.01 | 1.2 | 23 | 0.49 | 1.8 | Example |
| 123 | 5 | 25 | 0.07 | 0.75 | 15 | 0.30 | 1.5 | Example |
| 124 | 1 | 10 | −0.07 | 1.2 | 20 | 0.64 | 1.1 | Comparative Example |
| 125 | 3 | 10 | −0.05 | 0.75 | 10 | 0.28 | 1.9 | Example |
| 126 | 6 | 25 | −0.02 | 0.75 | 18 | 0.44 | 1.8 | Example |
| 127 | 7 | 10 | 0.07 | 0.75 | 27 | 0.20 | 2.1 | Comparative Example |
| 128 | 8 | 25 | 0.97 | 0.75 | 14 | 0.55 | 2.0 | Example |
| 129 | 8 | 25 | 0.51 | 0.75 | 14 | 0.55 | 2.0 | Example |
| 130 | 8 | 25 | 0.02 | 0.75 | 14 | 0.55 | 2.0 | Example |

TABLE 6

| Molded product No. | Maximum sheet thickness D1 [mm] | Minimum sheet thickness D2 [mm] | (D1 − D2)/D1 × 100 value | Maximum hardness H1 [mm] | Minimum hardness H2 [mm] | (H1 − H2)/H1 × 100 value | Recess depth/Protrusion height [μm] | $W_a$ [μm] | Visual observation evaluation | Remarks |
|---|---|---|---|---|---|---|---|---|---|---|
| | Molded product | | | | | | | | | |
| 101 | 1.2 | 0.90 | 25 | 150 | 100 | 33 | 3.4 | 1.6 | D | Comparative Example |
| 102 | 0.75 | 0.56 | 25 | 154 | 106 | 31 | 1.2 | 0.6 | B | Example |
| 103 | 0.75 | 0.56 | 25 | 163 | 109 | 33 | 1.4 | 0.4 | A | Example |
| 104 | 1.2 | 0.9 | 25 | 148 | 97 | 34 | 2.8 | 1.1 | C | Example |
| 105 | 1.6 | 1.2 | 25 | 150 | 105 | 30 | 1.8 | 0.4 | A | Example |
| 106 | 1.2 | 1.08 | 10 | 122 | 100 | 18 | 1.2 | 1.6 | D | Comparative Example |
| 107 | 0.75 | 0.68 | 10 | 133 | 109 | 24 | 1.2 | 0.3 | A | Example |
| 108 | 0.75 | 0.56 | 25 | 163 | 110 | 32 | 1.4 | 0.7 | B | Example |
| 109 | 0.75 | 0.68 | 10 | 124 | 102 | 18 | 2.5 | 1.6 | D | Comparative Example |
| 110 | 1.2 | 0.90 | 25 | 150 | 102 | 32 | 3.0 | 1.8 | D | Comparative Example |
| 111 | 0.75 | 0.56 | 25 | 154 | 103 | 33 | 1.0 | 0.7 | B | Example |
| 112 | 0.75 | 0.56 | 25 | 163 | 109 | 33 | 1.3 | 0.4 | A | Example |
| 113 | 1.2 | 0.9 | 25 | 148 | 97 | 34 | 2.5 | 1.2 | C | Example |
| 114 | 1.6 | 1.2 | 25 | 150 | 105 | 30 | 1.6 | 0.4 | A | Example |
| 115 | 1.2 | 1.08 | 10 | 122 | 100 | 18 | 1.2 | 1.7 | D | Comparative Example |
| 116 | 0.75 | 0.68 | 10 | 133 | 109 | 24 | 1.1 | 0.4 | A | Example |
| 117 | 0.75 | 0.56 | 25 | 163 | 110 | 32 | 1.3 | 0.8 | B | Example |
| 118 | 0.75 | 0.68 | 10 | 124 | 102 | 18 | 2.4 | 1.7 | D | Comparative Example |
| 119 | 1.2 | 0.90 | 25 | 150 | 103 | 31 | 2.9 | 2.0 | D | Comparative Example |
| 120 | 0.75 | 0.56 | 25 | 154 | 109 | 29 | 1.1 | 0.9 | B | Example |
| 121 | 0.75 | 0.56 | 25 | 163 | 112 | 31 | 1.3 | 0.5 | A | Example |
| 122 | 1.2 | 0.9 | 25 | 148 | 97 | 34 | 2.4 | 1.4 | C | Example |
| 123 | 1.6 | 1.2 | 25 | 150 | 103 | 31 | 1.5 | 0.5 | A | Example |
| 124 | 1.2 | 1.08 | 10 | 122 | 100 | 18 | 1.2 | 1.8 | D | Comparative Example |
| 125 | 0.75 | 0.68 | 10 | 133 | 109 | 24 | 1.1 | 0.5 | A | Example |
| 126 | 0.75 | 0.56 | 25 | 163 | 113 | 30 | 1.1 | 1.0 | B | Example |
| 127 | 0.75 | 0.68 | 10 | 124 | 103 | 17 | 2.1 | 1.7 | D | Comparative Example |
| 128 | 0.75 | 0.56 | 25 | 163 | 109 | 33 | 2.0 | 0.3 | A | Example |
| 129 | 0.75 | 0.56 | 25 | 163 | 109 | 33 | 2.3 | 0.4 | A | Example |
| 130 | 0.75 | 0.56 | 25 | 163 | 112 | 31 | 2.9 | 0.5 | A | Example |

The above-described results show that molded products No. 102 to 105, 107 to 108, 111 to 114, 116 to 117, 120 to 123, 125 to 126, and 128 to 130 of the corresponding Examples are excellent in design because of inhibition of abnormal grain growth, compared with molded products No. 101, 106, 109 to 110, 115, 118 to 119, 124, and 127 of the corresponding Comparative Examples.

Here, FIGS. 18 to 20 each schematically illustrate cross-sectional micro-texture and surface protrusions and recesses for molded products No. 102 and 103 of the corresponding Examples and a molded product No. 101 of the corresponding Comparative Example.

FIGS. 18 to 20 each schematically illustrate a cross-section of a molded product analyzed by the EBSD method. Note that ND represents a sheet thickness direction, and TD represents a sheet width direction in FIGS. 18 to 20.

A comparison of FIGS. 18 to 20 reveals that molded products No. 102 and 103 of the corresponding Examples are excellent in design because heights of protrusions and depths of recesses on the surface of a molded product are small, indicating inhibition of abnormal grain growth, compared with a molded product No. 101 of the corresponding Comparative Example. Note that a comparison of FIGS. 18 and 19 reveals that a molded product No. 103 is excellent in design because although heights of protrusions and depths of recesses on the surface of a molded product are larger than those of a molded product No. 102, abnormal grain growth is inhibited. This is because even when heights of protrusions and depths of recesses on the surface of a molded product are larger than or equivalent to those of a molded product No. 102, if recesses are deep and fine, it may be unlikely to be regarded as abnormal grain growth (see also a comparison of a molded product No. 106 and a molded product No. 107).

In addition, based on the above-described results, it is understood that abnormal grain growth of a molded product was inhibited for the molded products of the corresponding Examples in a wide range of deformation fields including an equi-biaxial tensile deformation field, a non-equi-biaxial tensile deformation field similar to an equi-biaxial tensile deformation field, a plane strain tensile deformation field, and a non-equi-biaxial tensile deformation field similar to a plane strain deformation field.

The embodiments and Examples of the disclosure are explained above. However, the above embodiments and Examples are merely exemplified for the implementation of the disclosure. Therefore, the disclosure is not limited to the above-described embodiments and Examples, and modifications may be made to the embodiments and Examples for the implementation of the disclosure within the scope of the effects of the disclosure, if appropriate.

The disclosures of Japanese Patent Application Nos. 2015-242460 and 2016-180635 cited in the present description are incorporated herein by reference in their entirety.

All publications, patent applications, and technical standards described herein are incorporated herein by reference in their entirety to the same extent as if the publications, patent applications, and technical standards have been written specifically and individually to be incorporated by reference.

The invention claimed is:

1. A method of producing a molded product, comprising:

treating a metal sheet having a bcc structure and a surface that satisfies either of the following conditions (a) or (b); and molding the metal sheet to cause plane strain tensile deformation and biaxial tensile deformation and allowing at least a part of the metal sheet to have a sheet thickness decrease rate of from 10% to 30%:

(a) an area fraction of crystal grains having a crystal orientation of 15° or less relative to a (001) plane parallel to the surface of the metal sheet is from 0.20 to 0.35;

(b) the area fraction of crystal grains having a crystal orientation of 15° or less relative to a (001) plane parallel to the surface of the metal sheet is 0.45 or less, and an average crystal grain size thereof is 10 μm to 15 μm.

2. The method of producing a molded product according to claim 1, wherein the metal sheet is a steel sheet.

3. The method of producing a molded product according to claim 1, wherein the metal sheet is a ferrite-based steel sheet having a metallic-structure ferrite fraction of 50% or more.

* * * * *